US005347928A

United States Patent [19]

Ito

[11] Patent Number: 5,347,928

[45] Date of Patent: Sep. 20, 1994

[54] PLATE CLAMPING UNIT FOR OFFSET PRESS

[75] Inventor: Mineyuki Ito, Gifu, Japan

[73] Assignee: Sakurai Graphic Systems Corporation, Tokyo, Japan

[21] Appl. No.: 35,635

[22] Filed: Mar. 23, 1993

[30] Foreign Application Priority Data

Oct. 29, 1992 [JP] Japan ..... 4-291827
Oct. 29, 1992 [JP] Japan ..... 4-291828
Oct. 29, 1992 [JP] Japan ..... 4-291829

[51] Int. Cl.[5] ..... B41F 1/28
[52] U.S. Cl. ..... 101/415.1; 271/206
[58] Field of Search ..... 101/415.1, 409, 378; 271/206

[56] References Cited

U.S. PATENT DOCUMENTS 3,230,883 1/1966 Achinger et al. ..... 101/415.1
3,903,796 9/1975 Jeschke et al. ..... 101/415.1
3,908,546 9/1975 Porter ..... 101/378
4,712,476 12/1987 Jeschke ..... 101/415.1
4,785,736 11/1988 Jeschke ..... 101/415.1
4,813,356 3/1989 Abendroth et al. ..... 101/415.1
4,977,833 12/1990 Inage et al. ..... 101/415.1
5,052,299 10/1991 Kojima ..... 101/415.1
5,076,167 12/1991 Herold et al. ..... 101/415.1
5,080,014 1/1992 Hofheinz ..... 101/415.1
5,094,165 3/1992 Sugiyama et al. ..... 101/415.1

*Primary Examiner*—Eugene H. Eickholt
*Attorney, Agent, or Firm*—Heller, Ehrman, White & McAuliffe

[57] ABSTRACT

A groove extends in the axial direction of a plate cylinder to which a printing plate is mounted. First and second plate clamps are opposite to each other in the groove to clamp the ends of the plate. The second clamp has a pair of clamping modules. The first and the second clamps are movable in the peripheral direction of the plate cylinder for opening motion. The holding portion of the clamp are moved in the radial direction of the plate cylinder for opening and closing motions. The first clamp is rotatably supported by the plate cylinder. The second clamp is shifted from a waiting position near the first clamp to a working position. A pair of the clamping modules is connected with each other via a connecting rod. The clamping modules are moved towards or away from each other to make the bottom end of the printing plate wider or narrower and remove the fanout of printing sheets. An adjusting bolt is screwed in the outer end portion of the module to move the second clamp in the direction of the axis of the plate cylinder.

28 Claims, 22 Drawing Sheets

PLATE CLAMPING UNIT FOR OFFSET PRESS

BACKGROUND OF THE INVENTION

1. Field of the Invention

The present invention relates to a plate clamping unit for use in an offset press. More particularly, the present invention pertains to a plate clamping unit which is able to adequately clamp an end of a printing plate mounted on a plate cylinder.

2. Description of the Related Art

FIG. 25 shows a general mechanical composition of an offset press machine. The offset press includes a group of rollers, a plate cylinder 200, a blanket cylinder 210, and an impression cylinder 211. Ink and water are fed from a group of inking rollers 212 and moistening rollers 213, respectively. The ink and the water are mixed and applied to the plate cylinder 200. Then, the mixture of ink and water is applied to a printing plate 204 mounted on the plate cylinder 200. The ink over the printing plate 204 is transferred to a blanket 214 on the blanket cylinder 210. Then, the ink over the blanket 214 is printed on printing sheets Pa on the impression cylinder 211. Thus, the state of the printing plate is printed on the sheets Pa at the second transfer.

Therefore, the setting state of the printing plate 204 around the plate cylinder 200 is a decisive factor of printing quality.

As shown in FIGS. 22 and 23, a groove 201 is formed on the outer peripheral surface of the plate cylinder 200. The groove 201 extends perpendicularly to the drawing sheet. A first and a second plate clamps 202, 203 are mounted in the groove 201 to clamp the top and bottom ends of the printing plate 204, respectively. The plate clamps 202, 203 are forcibly moved in the radial direction with respect to the plate cylinder 200 for the opening motion. The holding portions of the clamps 202, 203 are moved in the peripheral direction of the plate cylinder 200 for the opening motion. The printing plate 204 is made of a thin aluminum plate the both end of which are folded. The folded ends of the plate 204 are adequately placed in holding portions to be securely clamped by the clamps 202, 203. Thus, the printing plate 204 is held on the outer periphery of the plate cylinder 200.

As shown in FIG. 23, the first clamp 202 is fixed to the plate cylinder 200. A screw 207 is provided to adjust the distance between a pair of second plate clamps 205 and 206. A pair of torsion adjusting screws 208 and 209 is disposed in the distal end of the second clamps 205 and 206 so as to be advanced or retreated. The distal end of each torsion adjusting screws 208, 209 is in contact with the inner wall of the groove 201, respectively.

When the printing plate 204 is mounted on the plate cylinder 200, with some torsion as shown in the chain line in FIG. 23, the torsion can be removed by retreating the screw 208 and advancing the screw 209 to move the second clamps 205, 206 for expanding the end of the plate 204.

As shown in FIG. 24, in the offset press, the printing sheet Pa on the impression roller 211 receives printing pressure and a small amount of water. This causes to expand an end of each sheet Pa, as shown by chain line, when the multicolor printing is carried out. This end expansion is called "fanout" by the operators. If further printing is made on the printing sheet Pa, the printed images would shrink as the printing sheet Pa dries and shrinks to the original size. To counter this fanout, the screws 208, 209 are advanced, the screw 207 being manipulated to widen the distance between the clamps 205, 206 and expanding the end of the plate 204.

However, it is time consuming and tiresome to fold the ends of the printing plate 204. Furthermore, for folding a printing plate made of aluminum, a dedicated folding machine is required, resulting in the high cost.

Moreover, the two screws 208, 209 at the both ends of the clamp 203 must be manipulated by turning to adjust the torsion of the printing plate 204. The screws 208 and 209 at the both ends of the clamps 205, 206 and the screw 207 between the clamps 205, 206 must be alternately manipulated for preventing the sheet Pa from the fanout. This troublesome adjusting operation reduces the efficiency of the work.

SUMMARY OF THE INVENTION

An object of the present invention is to provide a plate clamping unit which is able to accurately mount a printing plate on a cylinder for obtaining a good printing quality.

A further object of the present invention is to provide a plate clamping unit which eliminates the need for folding operation of a printing plate.

A still further object of the present invention is to provide a plate clamping unit with which the torsion of a printing plate can be easily adjusted.

Another object of the present invention is to provide a plate clamping unit which is able to counter the fanout phenomenon of printing sheets.

In a plate clamping unit according to the present invention, a first and second plate clamping mechanisms are moved in the radial direction of the plate cylinder for the opening and closing motion. For holding the printing plate, the second plate clamping mechanism is moved from a waiting position to a working position by a moving mechanism. At this time, the second plate clamping mechanism remains in the open state. For this arrangement, both ends of the printing plate can be firmly clamped.

In the event that the printing plate is twisted with respect to the plate cylinder, a screw is advanced or retreated to adjust the torsion. Then, the plate clamping mechanisms is moved in the axial direction of the plate cylinder while being pressingly supported in a groove by way of the force of biasing members. Subsequently, the printing plate is moved together with the plate clamping mechanism. As a result, the torsion of the printing plate is adjusted.

When the length of the second plate clamping mechanism is to be adjusted in the axial direction of the plate cylinder, a connecting member is manipulated to change the distance between clamping modules. As a result, the length of the second clamping mechanism is expanded or shortened. At this time, an end of the second clamping mechanism is pressed to the inner wall of the setting groove by the force of a biasing member. Therefore, the length of the second clamping mechanism can be easily adjusted in the axial direction with respect to the plate cylinder.

BRIEF DESCRIPTION OF THE DRAWING

The invention, together with objects and advantages thereof, may best be understood by reference to the following description of the presently preferred embodiments together with the accompanying drawings in which.

DESCRIPTION OF THE PREFERRED EMBODIMENTS

A preferred embodiment of a plate clamping unit according to the present invention will now be described with reference to FIGS. 1 through 21.

Figure 1:
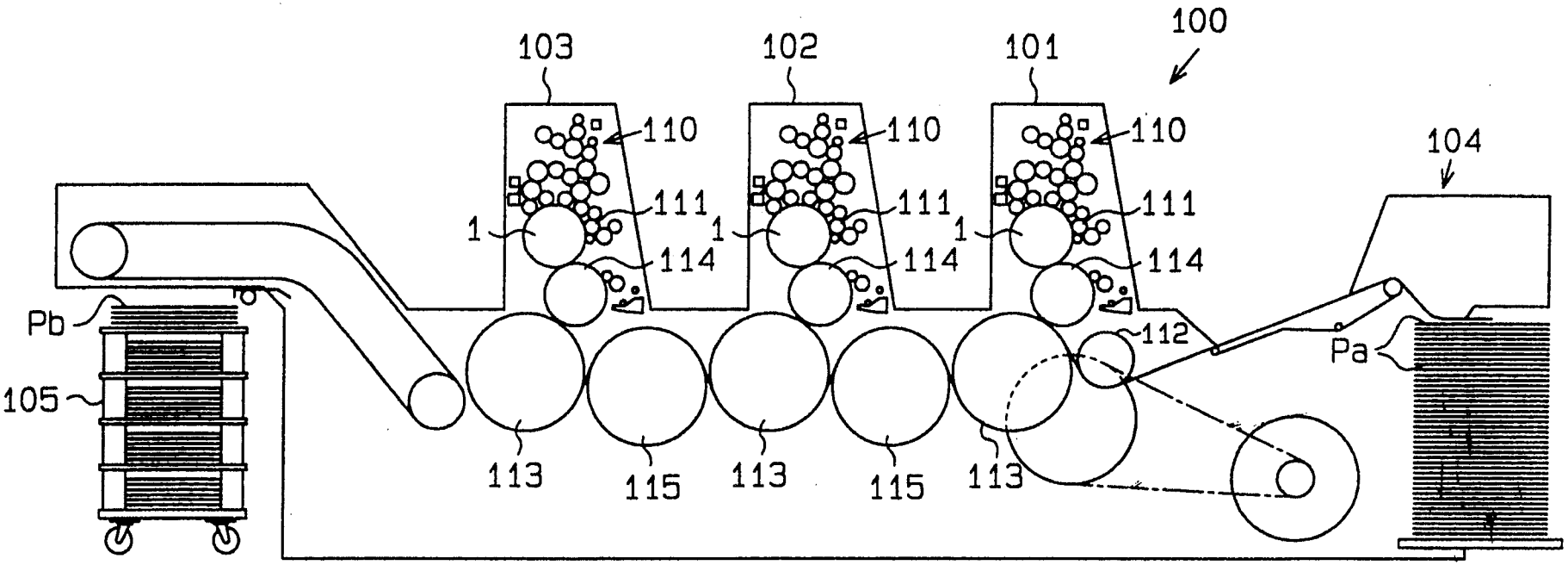
FIG. 1 is a schematic of an offset press embodying the present invention.

FIG. 1 shows a three-color offset press 100. The offset press 100 includes a first-color printing unit 101, a second-color printing unit 102 and a third-color printing unit 103. A feeder 104 is located near the first-color printing unit 101 at the feeding side. A delivery unit 105 is located near the third-color printing unit 103 at the delivery side. In each of the printing units 101, 102 and 103, ink is fed to a plate cylinder 1 via inking rollers 110. On the other hand, water is fed to the plate cylinder 1 via moistening rollers 111.

The ink and the water fed to the cylinder 1 are mixed with each other over a printing plate 3 (FIGS. 7 and 11) held around the cylinder 1. The ink left is on the plate 3 in the form of images to be printed, and transferred to a blanket held around a blanket roller 114.

Printing sheets Pa are fed from the feeder 104 to the first-color printing unit 101 via a delivery cylinder 112. The printing sheet Pa held around the outer periphery of an impression cylinder 113 comes to contact with the outer periphery of the blanket cylinder 114. While the printing sheet Pa is in contact with the outer periphery of the blanket cylinder 114, the inked images in the first color transferred to the blanket are printed on the printing sheet Pa. Printing is made all over the printing sheet Pa when the blanket cylinder 114 is rotated by the rotation of the impression cylinder 113. Then, the printing sheet Pa is fed to an impression cylinder 113 of the second-color printing unit 102 via a delivery cylinder 115.

In the second-color printing unit 102, the printing sheet Pa held around the outer periphery of the impression cylinder 113 comes to contact with the outer periphery of a blanket cylinder 114. Then, the inked images in the second color are printed on the printing sheet Pa in the same way as the first-color printing is made by the first-color printing unit 101.

Then, the printing sheet Pa is fed to the third-color printing unit 103. The third-color printing is made in the same way as the first-color printing and second-color printing. When the printing sheet Pa printed as described above is fed to the delivery unit 105, the whole procedure of the printing is completed.

Figure 17:
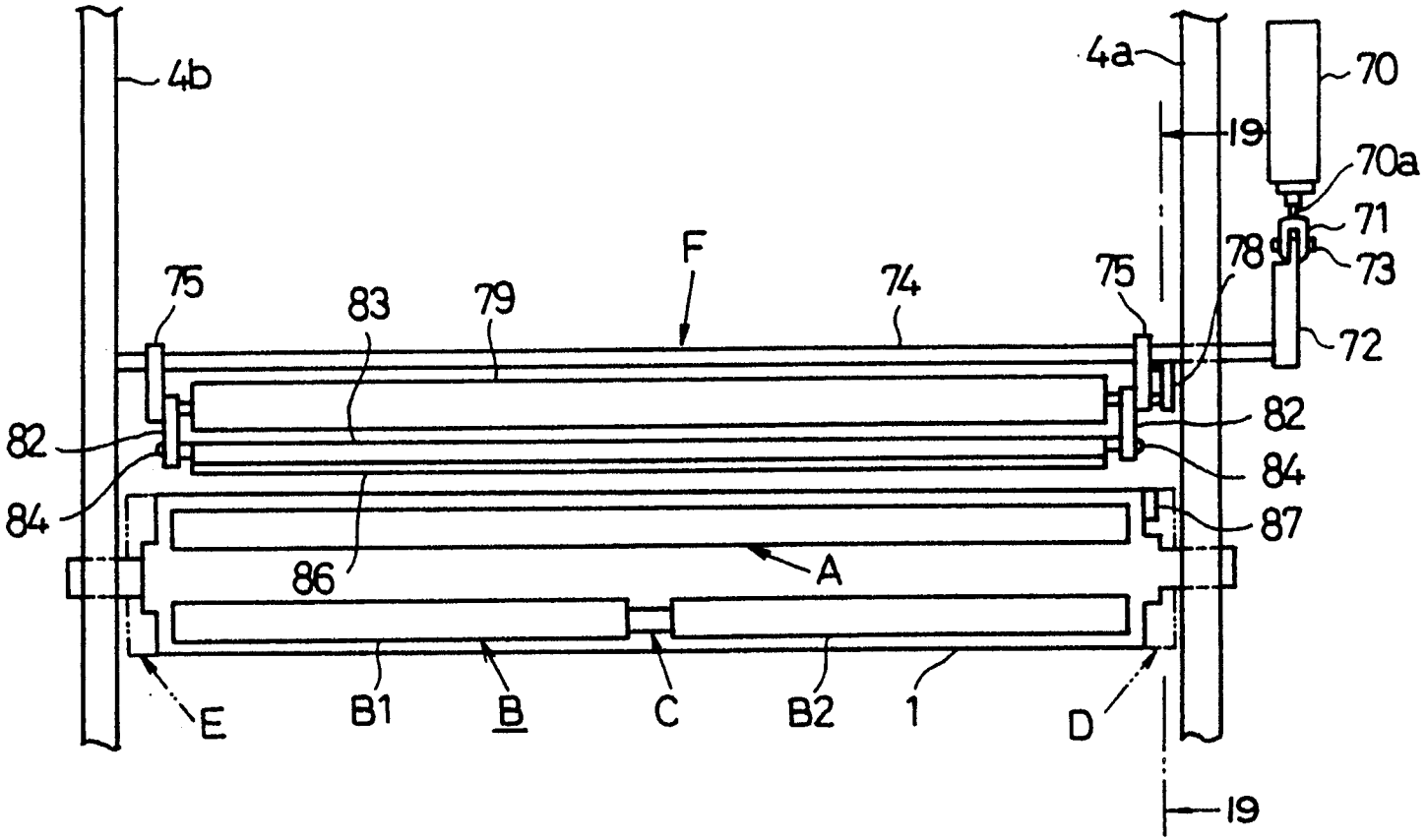
FIG. 17 is a plan view showing the plate cylinder and a plate holding mechanism.

Now, the plate clamping unit employed in each of the printing units 101, 102 and 103 will be described. Since the printing units 101, 102 and 103 have the same mechanical composition, description is given only of the first-color printing unit 101 as follows:

As shown in FIG. 17, the plate cylinder 1 is rotatably supported between side walls 4*a* and 4*b* of the first-color printing unit 101. The outer periphery of the plate cylinder 1 is structured such that the printing plate 3 (FIG. 11) can be set therearound. The plate 3 comprises a thin aluminum plate. A plate holding mechanism F is provided between the side walls 4*a* and 4*b* to hold the plate set around the plate cylinder 1.

Figure 2:
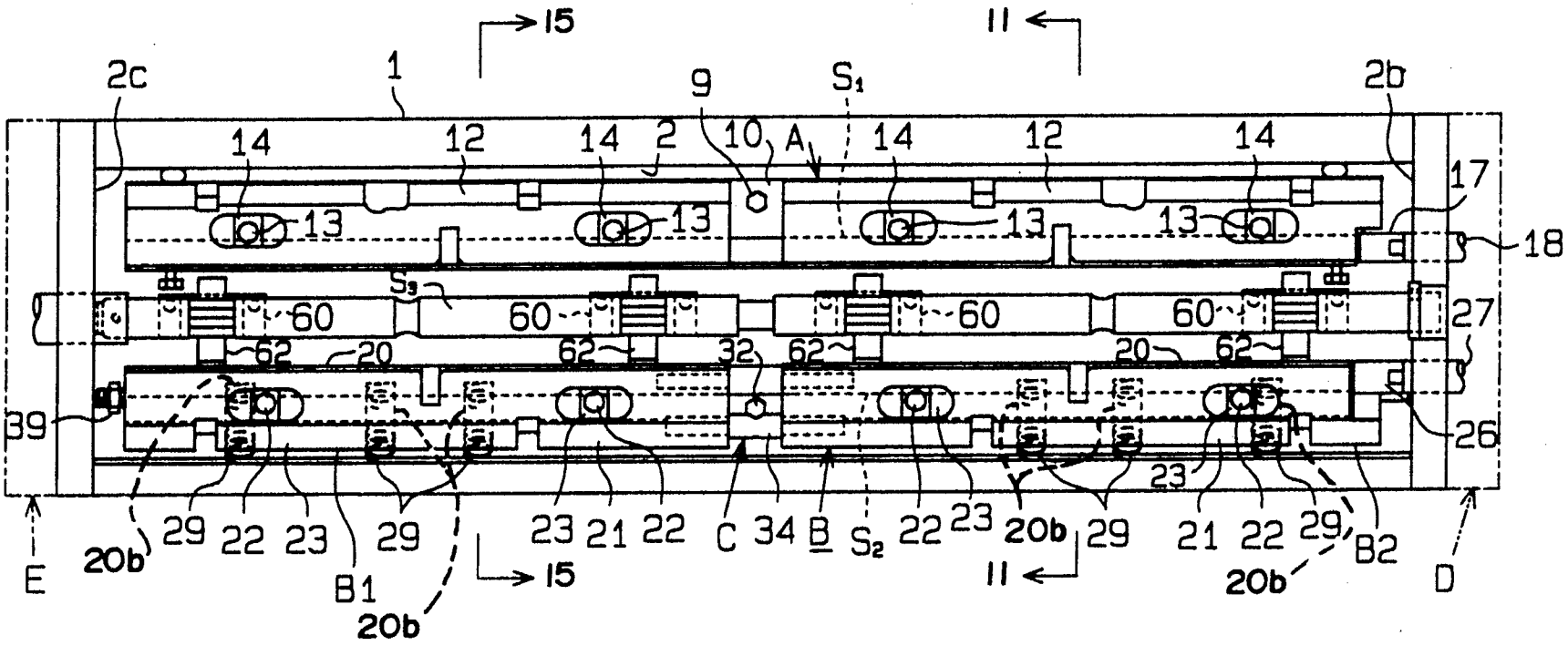
FIG. 2 is a plan view of a plate cylinder according to an embodiment of the present invention.

As shown in FIG. 2, a setting groove 2 is formed in the outer periphery of the plate cylinder 1. The groove extends in the longitudinal direction of the plate cylinder, i.e., in the axial direction of the plate cylinder 1. A first plate clamp A and a second plate clamp B are disposed in the groove. The clamps A and B extend in the longitudinal direction of the groove 2 and face each other. The first plate clamp A is designed to seize the top end of the plate 3, and the second plate clamp B is designed to seize the bottom end of the plate 13. The plate clamps A and B are spaced in the peripheral direction of the plate cylinder 1. The clamping portions of the first and second plate clamps A and B are moved in the radial direction of the plate cylinder 1 for the opening and closing motions.

The second plate clamp B includes a pair of clamping modules B1 and B2. An adjusting mechanism C is disposed between the clamping modules B1 and B2. The adjusting mechanism C adjusts the width of the printing plate 3 to adjust a fanout. In other word, an adjusting screw adjusts the end width of the printing plate 3 or the squareness of the printing plate 3 on the plate cylinder 1.

In FIG. 2, a clamp activating mechanism D is located at the right end of the plate cylinder 1 to activate the first and second plate clamps A and B to seize the printing plate 3. A clamp moving mechanism E is located at the left end of the plate cylinder 1 to move the second clamp B towards the first plate clamp A or away therefrom.

Next, the first plate clamp A will be described.

Figure 11:
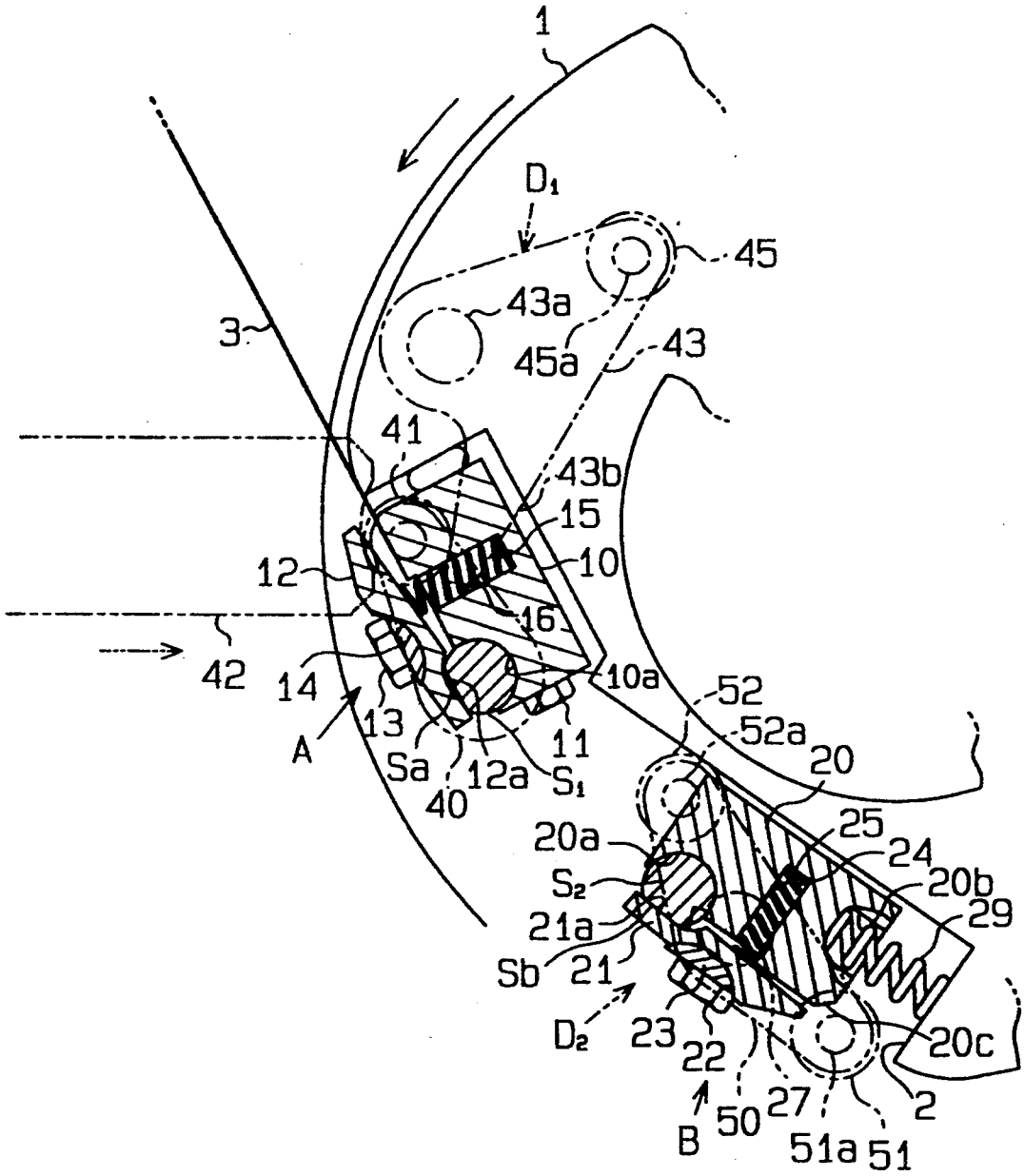
FIG. 11 is a cross sectional view taken along line 11—11 of FIG. 2, illustrating the state before a first plate clamp clamps a printing plate.
Figure 16:
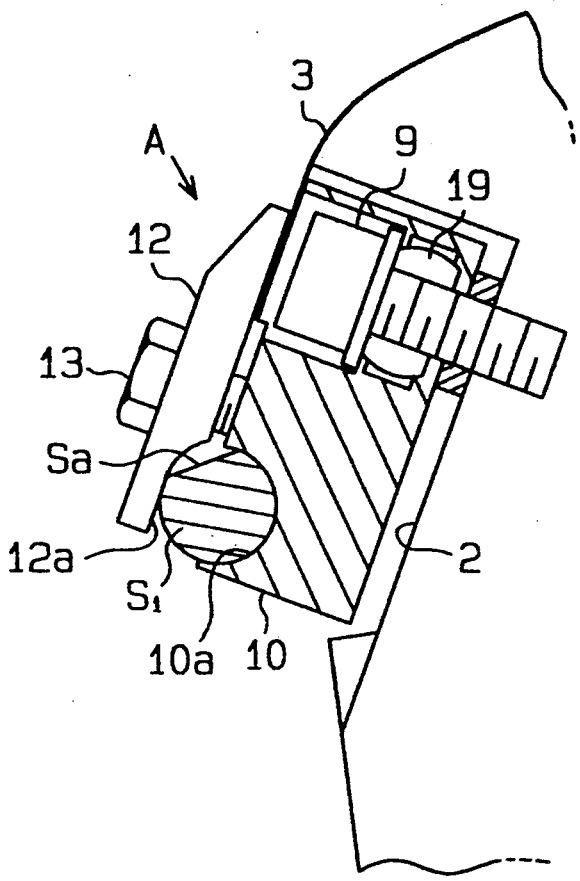
FIG. 16 is a cross sectional view showing a central part of the first plate clamp taken in the longitudinal direction.

As shown in FIGS. 11 and 16, a longitudinally extending clamping block 10 is housed in the groove 2. A bearing 19 is fixed to the central portion of the clamping block 10. The clamping block 10 is rotatably supported by the plate cylinder 1 by means of a bolt 9. The bolt 9 is inserted through the clamping block 10 and the bearing 19, and screwed into the inner bottom of the setting groove 2.

As shown in FIG. 2, a pair of movable clamping plates 12 is located on the clamping block 10. As shown in FIGS. 11 and 16, the movable clamping plates 12 are attached to the respective clamping blocks 10 by means of a plurality of bolts 13 with an allowance for the upward or downward movement of the movable clamping plate 12. The bolts 13 are screwed into the clamping blocks 10. A washer 14 is placed between each movable clamping plate 12 and bolt 13.

A cam way 10*a* is formed at the top of the inner end portion of each clamping block 10 so as to extend longitudinally with respect to the block 10. A step 12*a* is formed at the bottom of the inner end of each movable clamping plate 12. The step 12*a* extends longitudinally with respect to the plate 12 so as to face the cam way 10*a*. A cam shaft S1 set in the cam way 10*a* opposes the step 12*a*. The cam shaft S1 extends along the first plate clamp A up to the vicinity of the side wall 2*b* of the groove. A cam face Sa is formed on the cam shaft S1.

Figure 12:
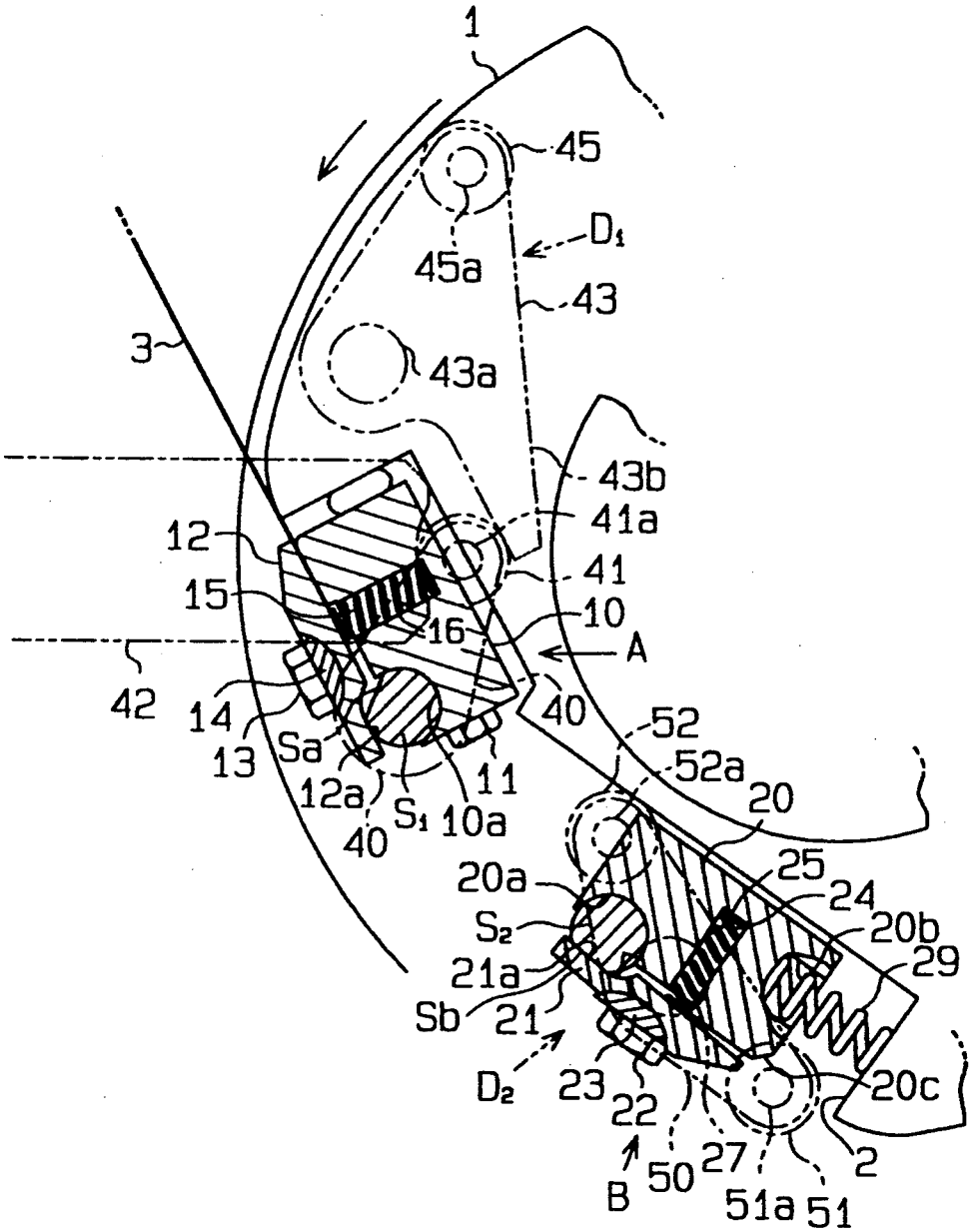
FIG. 12 is a cross sectional view taken along line 11—11 of FIG. 2, illustrating the state after the first plate clamp clamps the printing plate.

As shown in FIG. 11, a plurality of spring housing holes 16 are formed in each clamping block 10. The spring housing holes 16 are open toward the respective movable clamping plates 12 and opposite to the cam way 10*a* with respect to the bolt 13. A compression coil spring 15 disposed in each spring housing hole 16 faces the movable clamping plate 12. The step 12*a* is continuously pressed against the cam shaft S1 by the force of each compression coil spring 15. The outside end portion of each movable clamping plate 12 is held in open position with respect to the clamping block 10. Therefore, as shown in FIG. 11, when the cam face Sa is in contact with the chipped portion 12*a*, the outside end portion of each movable clamping plate 12 is held open by the force of the compression coil spring 15. On the other hand, as shown in FIG. 12, when the cam face Sa is not in contact with the chipped portion 12*a*, the outside end portion of each movable clamping plate 12 is held in closed position by the force of the compression coil spring 15.

As shown in FIG. 2, a connecting shaft 18 is rotatably supported by the side wall 2*b*. The connecting shaft 18 is connected with the outer end of the cam shaft S1 via a cylindrical coupling 17.

The second plate clamp B will be described next.

As shown in FIGS. 2 and 11, a pair of clamping blocks 20 is spaced in the setting groove 2. The position of each clamping block 20 can be switched from the solid line position in FIG. 11 to the solid line position in FIG. 13 or vice versa.

A movable clamping plate 21 is disposed at the top of each clamping block 20. The clamping plates 21 are attached to the clamping blocks 20 by means of bolts 22. The plates 21 are allowed to move upward or downward. The bolt 13 is inserted through the movable clamping plate 21, and screwed into the clamping block 20. A washer 23 is placed between the movable clamping plate 21 and the bolt 22. A cam way 20*a* is longitudinally formed at the top of the inside end portion of each clamping block 20. A chipped portion 21*a* is longitudinally formed at the bottom of the inside end portion of each movable clamping plate 21 correspondingly facing the cam way 20*a*. A cam shaft S2 set in the cam way 20*a* faces the step 21*a*. The cam shaft S1 longitudinally extends along the second plate clamp B up to the vicinity of the side wall 2*b* of the groove. A cam face Sb is formed on the cam shaft S2.

Figure 13:
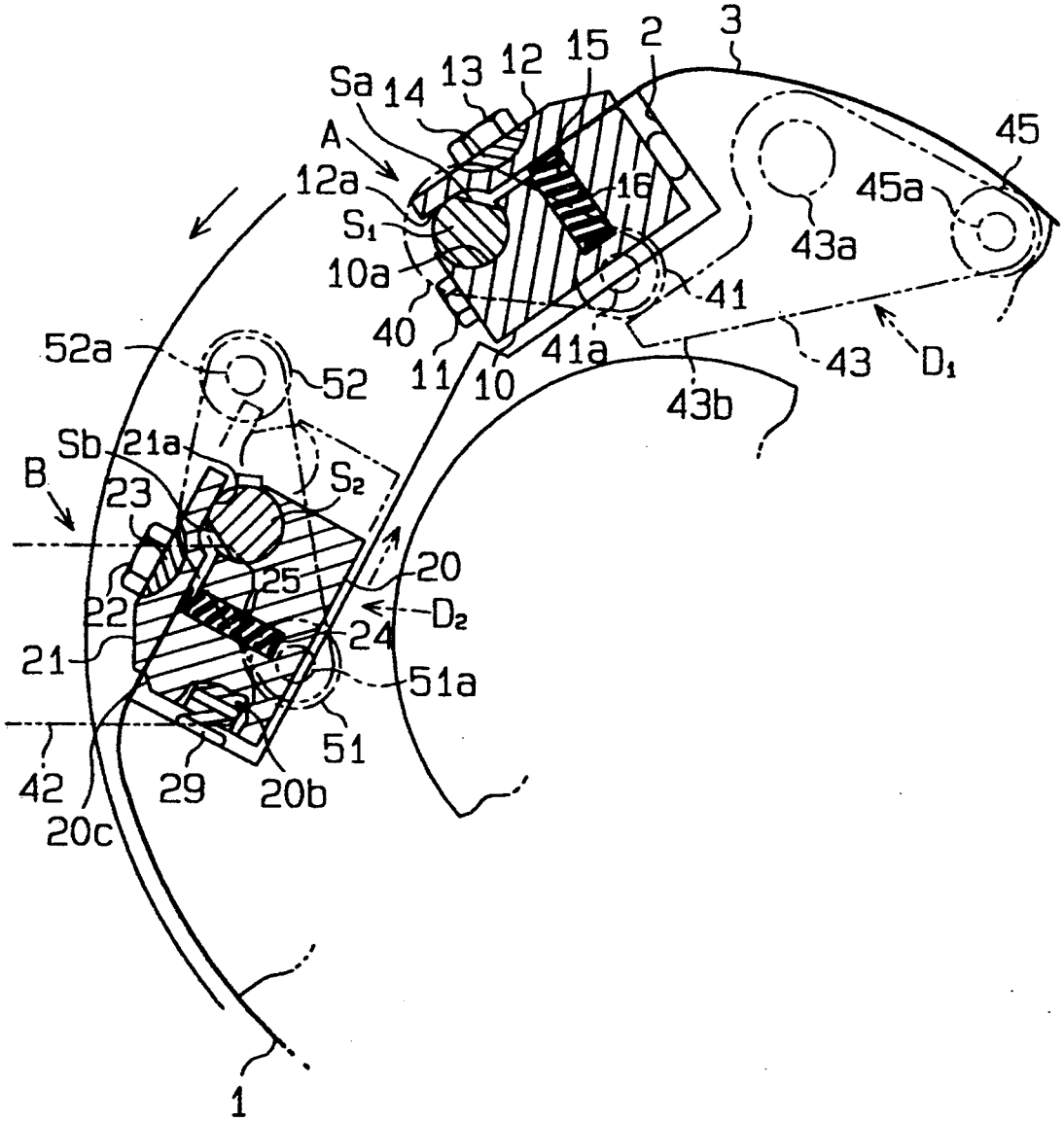
FIG. 13 is a cross sectional view taken along line 11—11 of FIG. 2, illustrating the state after a second plate clamp clamps the printing plate.

As shown in FIG. 11, a plurality of spring housing holes 25 are formed in each clamping block 20. The spring housing holes 25 are open to the respective plates 21 and opposite the cam way 20*a*. A compression coil spring 24 set in each spring housing hole 25 faces the clamping plate 21. The step 21*a* is continuously pressed against the cam shaft S2 by the force of each spring 24. The outer end of each clamping plate 21 is open toward the clamping block 21. Therefore, as shown in FIG. 11, when the cam face Sb is in contact with the step 21*a*, the outer end of each clamping plate 21 is held in open position by the force of the spring 24. As shown in FIG. 13, when the cam face Sb is not in contact with the step 21*a*, the outside end portion of each movable clamping plate 21 is held in closed position by the force of the compression coil spring 24.

The outside end portion of each clamping block 20 protrudes from the outside end of each movable clamping plate 21. The end corner of each clamping block 20 is chamfered to form a chamfer 20*c* to smoothly guide the printing plate 3.

Figure 4:
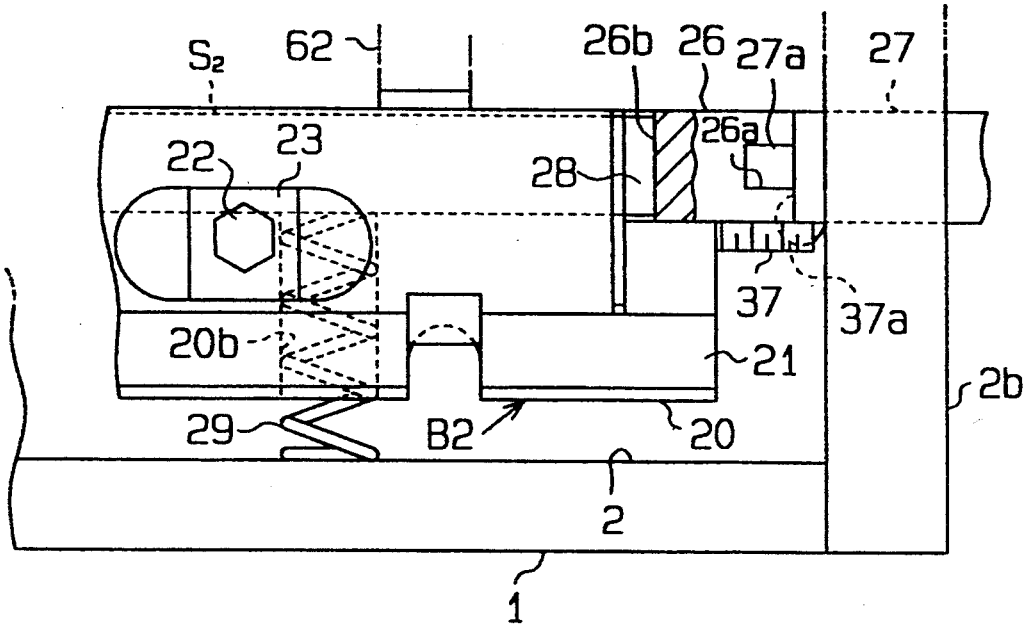
FIG. 4 is a plan view of the second plate clamp.

As shown in FIG. 4, a connecting shaft 27 is inserted through the side wall 2*b* and rotatably supported thereby. The connecting shaft 27 is connected with the outside end portion of the cam shaft S2 via a cylindrical coupling 26. A pair of engaging grooves 26*a* and 26*b* is formed at both end portions of the coupling 26, the grooves 26*a* and 26*b* lying perpendicularly to each other. An engaging projection 28 formed on the cam shaft S2 and an engaging projection 27*a* formed on the connecting shaft 27 engage with each other in the engaging grooves 26*a* and 26*b*. More specifically, the two projections 27*a* and 28 are engaged to one another slidably in the radial direction of the coupling 26. The coupling 17 described above is structured similarly to the coupling 26. The connecting shaft 18 and the cam shaft S1 are connected to the coupling 17 so as to be able to slide in the radial direction of the coupling 17.

Figure 3:
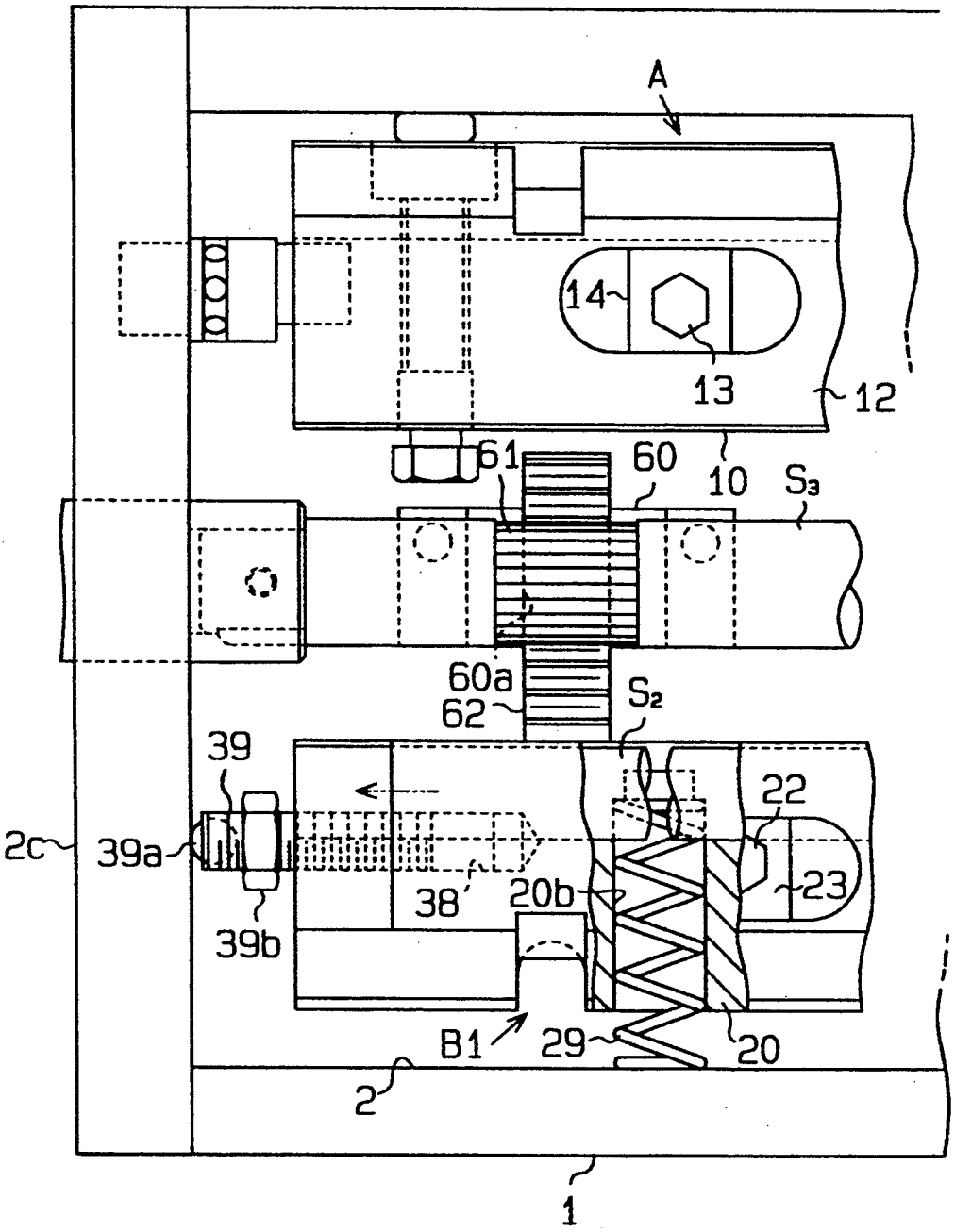
FIG. 3 is a plan view showing a first plate clamp and a second plate clamp.
Figure 15:
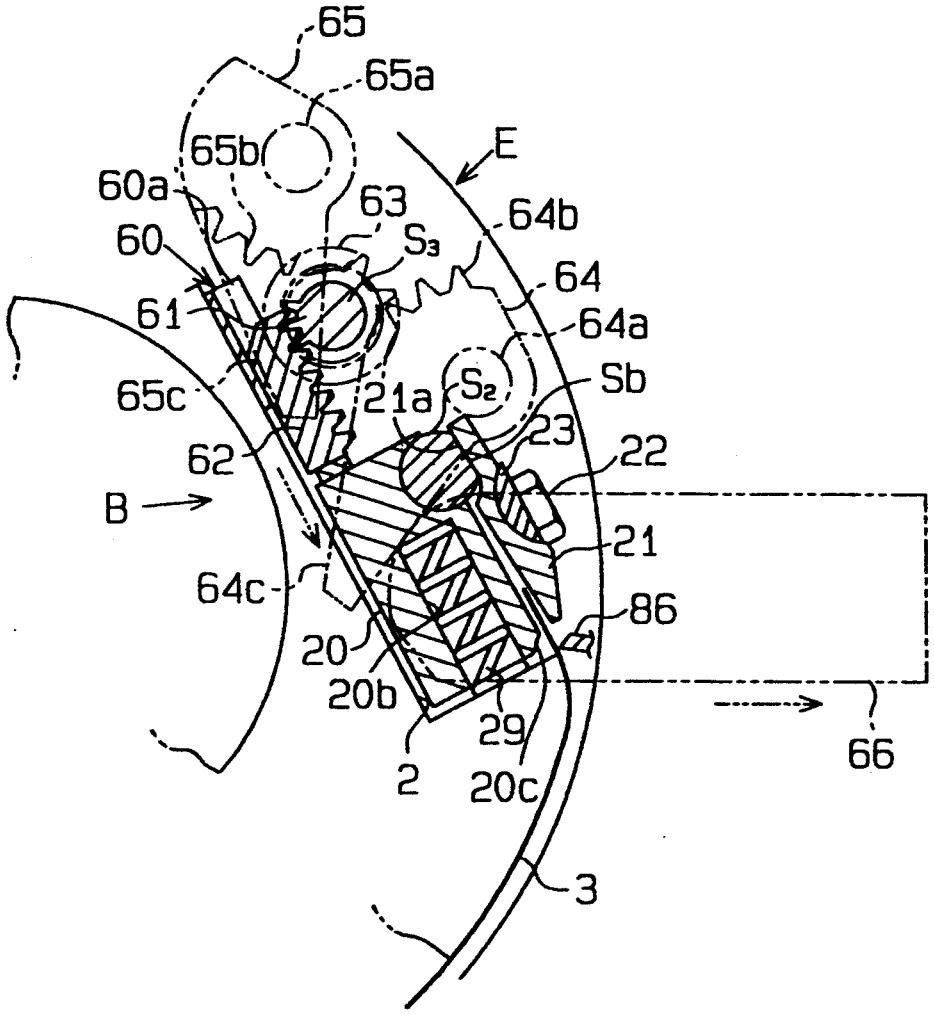
FIG. 15 is a cross sectional view taken along line 15—15 of FIG. 2, illustrating the state after the movement of the second plate clamp by means of the moving mechanism.

As shown in FIGS. 3 and 15, a plurality of spring housing holes 20*b* are formed in each clamping blocks 20. A coil spring 29 is housed in each hole 20*b* and in contact with the inner wall of the groove 2. The clamping blocks 20 are continuously pressed against the first clamp A by the force of the springs 29.

The adjusting mechanism C will be described next.

Figure 6:
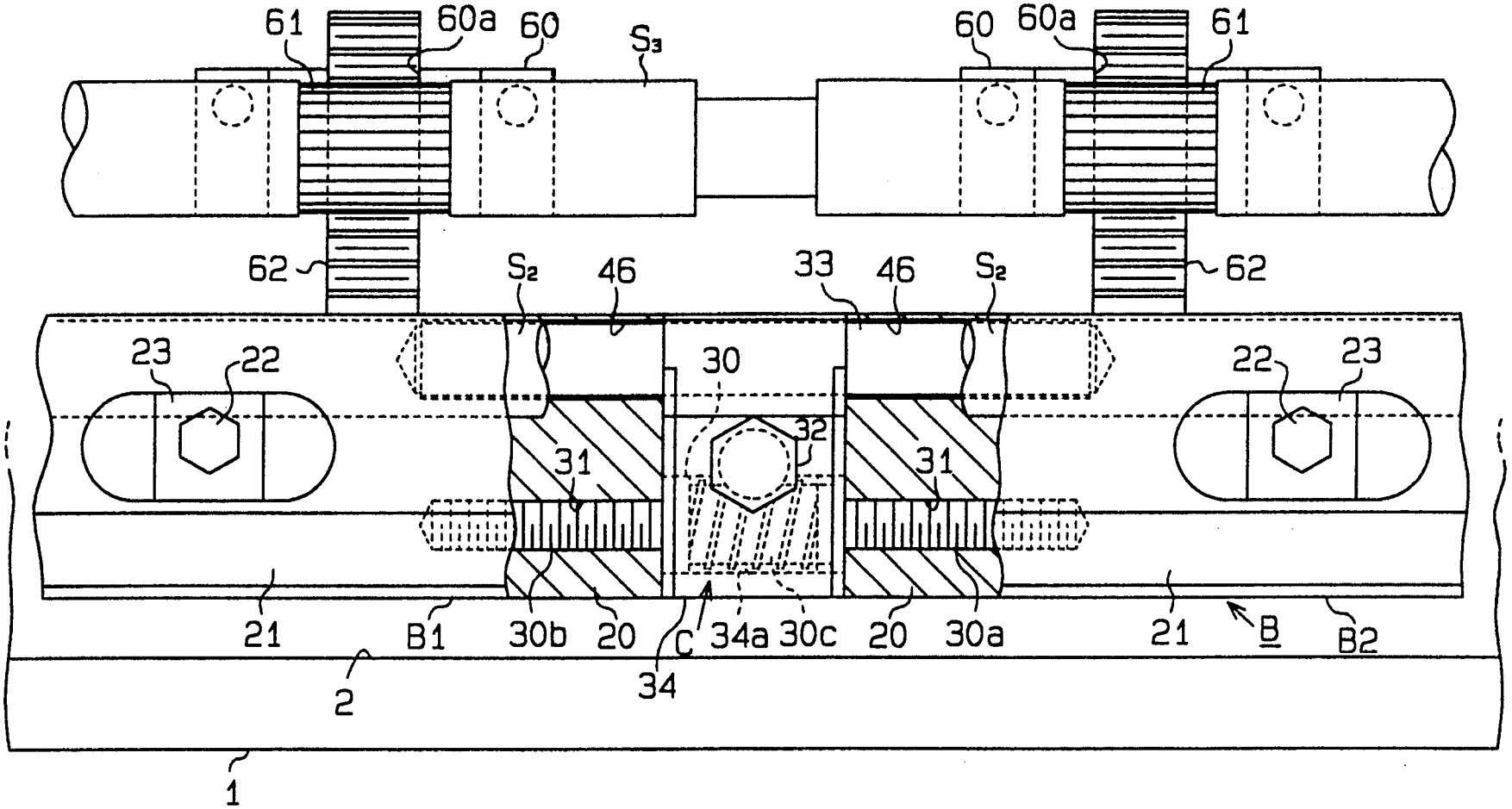
FIG. 6 is a plan view showing an adjusting mechanism.
Figure 8:
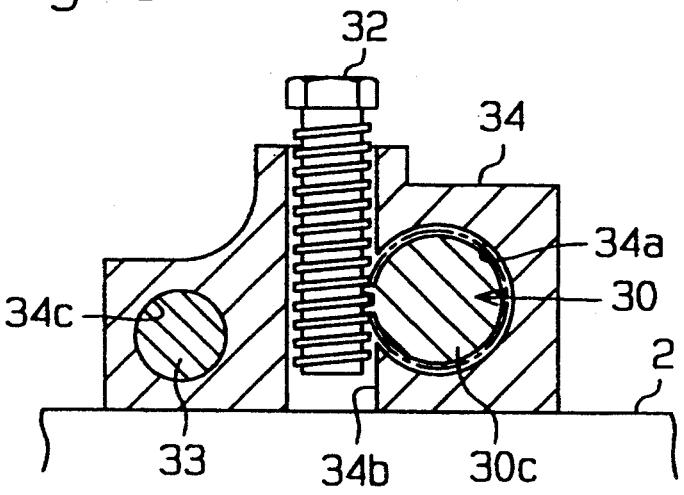
FIG. 8 is a cross sectional view showing the adjusting mechanism.

As shown in FIGS. 6 and 8, a connecting block 34 is located between the clamping blocks 20. The connecting block 34 is slidable with respect to the bottom of the groove 2. A hole 34*a* is formed through the connecting block 34, extending in the axial direction of the plate cylinder 1. A connecting rod 30 is inserted through the hole 34*a* in the connecting block 34, and rotatably supported thereby to connect the two clamping blocks 20. Male screw portions 30*a*, 30*b* are formed at both end portions of the connecting rod 30. The two portions 30*a*, 30*b* are threaded in mutually opposite directions such that the both portions 30*a* and 30*b* are driven forward or backward through female screw portions 31 formed at end sections of the clamping blocks 20. A worm gear 30*c* is formed at the central portion of the connecting rod 30 between the portions 30*a*, 30*b*.

A hole 34*b* is formed in the connecting block 34. The hole 34*b* extends perpendicularly to and communicates with another hole 34*a*. An adjusting worm 32 engaged with the worm gear 30*c* is rotatably disposed in the hole 34*b* for simultaneously turning with the rod 30. This turning movement of the rod 30 drives the screw 30*a*, 30*b* forward or backward to move the clamping blocks 20 toward or away from each other. In other words, the length of the second plate clamp B can be freely adjusted.

Still another hole 34*c* is formed in the connecting block 34. The hole 34*c* extends in parallel with the hole 34*a* and perpendicularly to the hole 34*b*. A guide pin 33 is firmly fixed into the hole 34*c*. The guide pin 33 is slidably inserted into a hole 46 formed in the outer end of each clamping block 20. The guide pin 33 guides the movement of each clamping block 20 to adjust the length of the second clamp B.

Figure 5:
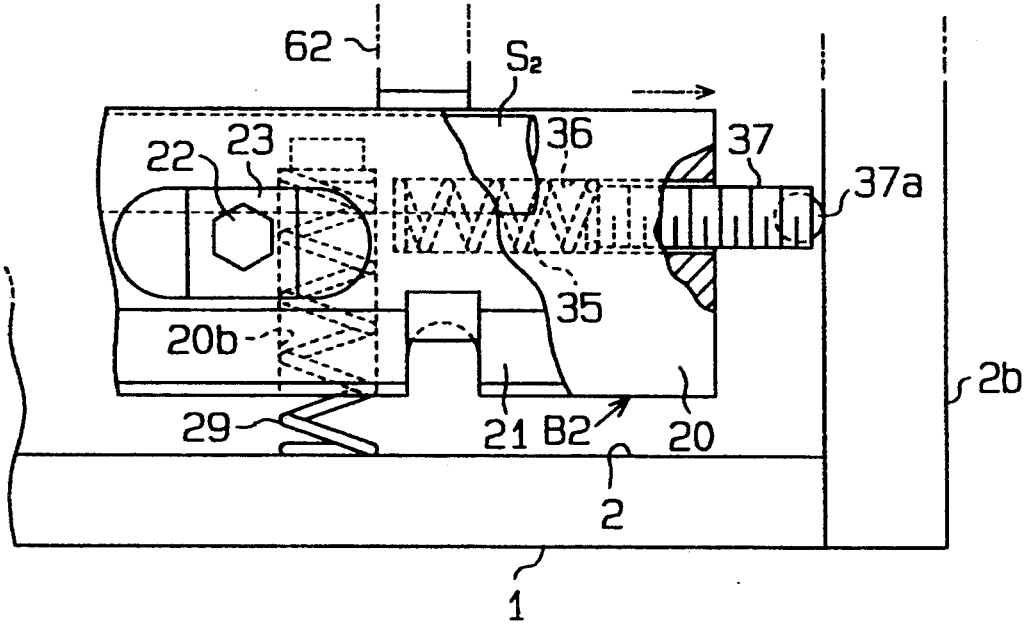
FIG. 5 is a plan view showing the second plate clamp.

As shown in FIG. 5, a housing hole 36 is formed at the right end of the clamping block 20. A plunger 37 is housed in the hole 36 with a coil spring 35. The plunger 37 is arranged to slide in the axial direction of the plate cylinder 1. A ball 37*a* is rotatably supported at the outer end of the plunger 37 so as to contact the side wall 2*b*. The right end of the plunger 37 is continuously pressed against the side wall 2*b* by the force of the spring 35.

On the opposite side, as shown in FIG. 3, a female screw 38 is formed in the left end portion of the left-hand clamping block 20. An adjusting bolt 39 is screwed in the screw 38 so as be driven forward or backward to adjust the squareness of the printing plate 3. A ball 39*a* is rotatably supported at the outer end of the adjusting bolt 39 so as to contact the wall 2*c* of the groove 2. A nut 39*b* is integrally formed with the adjusting bolt 39. The second plate clamp B can be moved in the axial direction of the plate cylinder 1 by adjusting the length of the female screw 38 inserted into the clamping block 20.

The clamp activating mechanism D will be described next.

The clamp activating mechanism D includes a first clamp activating mechanism D1 and a second clamp activating mechanism D2. The first clamp activating mechanism D1 is designed to activate the first plate clamp A, and the second clamp activating mechanism D2 is designed to activate the second plate clamp B.

Figure 9:
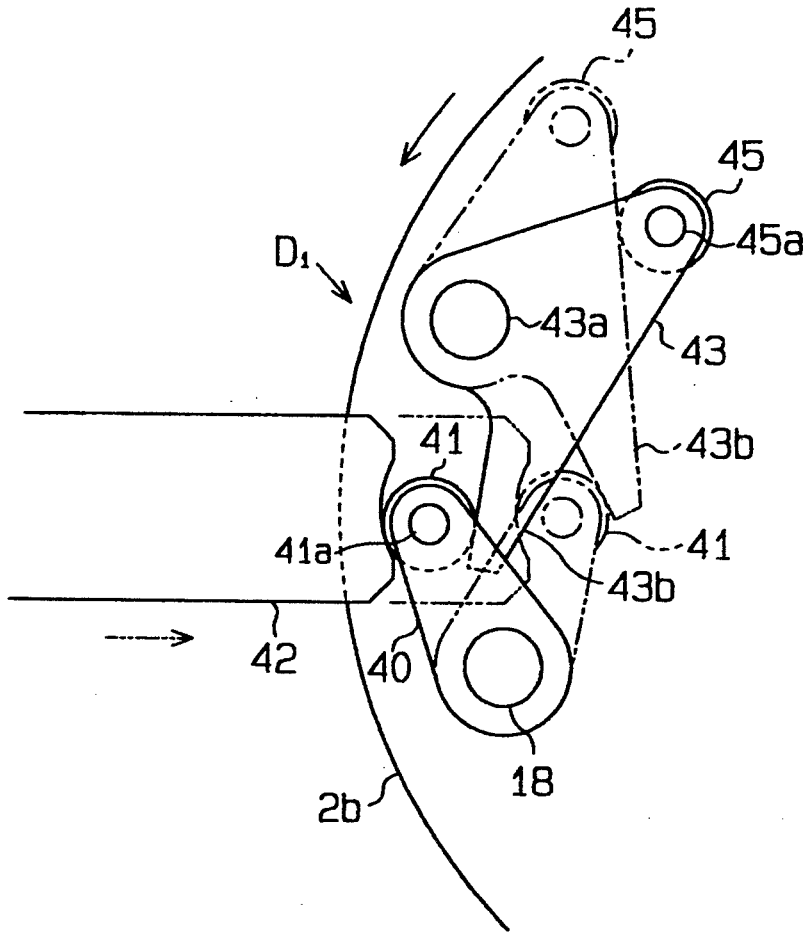
FIG. 9 is a side view of a first clamp adjusting mechanism.

As shown in FIGS. 9, 11 and 12, a plate clamping lever 40 is fixed to the shaft 18 connected to the cam shaft in FIG. 2. A plate clamping roller 41 is rotatably supported by a shaft 41*a* at an end portion of the plate clamping lever 40. When the first plate clamp A is going to seize the top end of the printing plate 3, the plate cylinder 1 is turned. Then, the plate clamping roller 41 is moved to the position where the plate clamping roller 41 can contact an end of a driving arm 42. The driving arm 42 flexibly reciprocates in the axial direction of the cylinder 1 by means of an air cylinder (not illustrated) which is actuated by manipulating an operation switch (not shown).

A plate releasing lever 43 is pivotally supported by a pivot 43*a* on the side wall 2*b*. An abutting portion 43*b* is integrally formed with the releasing lever 43. The abutting portion 43*b* extends to contact with the pivoting locus of the plate clamping roller 41. The portion 43*b* is in contact with the clamping roller 41. A plate releasing roller 45 is rotatably supported by the shaft 45*a*. When the first clamp A is going to release the top end of the printing plate 3, the plate cylinder 1 is turned, and the plate releasing roller 45 is moved to the position where the plate releasing roller 45 can meet the end of the driving arm 42.

When the first clamp A is going to seize the top end of the printing plate 3, the driving arm 42 moves in the radial direction of the cylinder 1 and abuts the clamping roller 41. Then, the clamping lever 40 is pivoted clockwise to a position shown by the chain line in FIG. 9, and the releasing lever 43 is pivoted counterclockwise. Subsequently, as shown in FIG. 12, the cam shaft S1 is turned via the connecting shaft 18 in the same direction as that of the plate releasing lever 43. Then, each clamping plate 12 is moved to the close position against the force of the spring 15. As a result, the top end of the printing plate 3 is clamped by the clamping plates 12.

In reverse, when the first clamp A is about to release the top end of the printing plate 3, the driving arm 42 movers in the radial direction of the plate cylinder 1 and abuts the releasing roller 45, and the releasing levers 43 and the clamping roller 41 are returned to the position shown by the solid line in FIG. 9. Subsequently, the cam shaft S1 is turned in the direction opposite to the direction when the printing plate 3 is seized, and each clamping plate 12 is opened by the force of the spring 15. As a result, the top end of the printing plate 3 is released from the clamping plates 12.

The second clamp activating mechanism D2 is described next.

Figure 10:
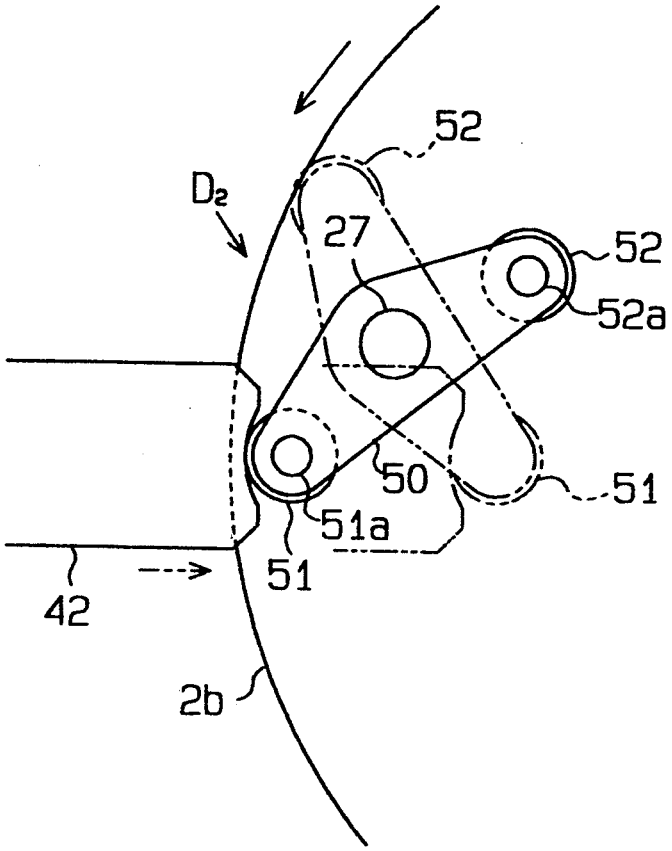
FIG. 10 is a side view showing a second clamp adjusting mechanism.

As shown in FIGS. 10 and 13, a lever 50 is fixed on the connecting shaft 27 connected to the cam shaft S2. A plate clamping roller 51 and a plate releasing roller 52 are rotatably supported by shafts 51*a* and 52*a* respectively. When the second plate clamp B is going to clamp the bottom end of the printing plate 3, the plate cylinder 1 is turned, and the plate clamping roller 51 is moved to the position where the plate clamping roller 51 can meet an end of the driving arm 42. When the second plate clamp B is going to release the bottom end of the printing plate 3, the plate cylinder 1 is turned, and the plate releasing roller 52 is moved to the position where the plate releasing roller 52 can meet the end of the driving arm 42.

When the second plate clamp B is going to clamp the bottom end of the printing plate 3, the driving arm 42 strikes the plate clamping roller 51, and the lever 50 is turned counterclockwise to the chain line position in FIG. 10. Then, as shown in FIG. 13, the cam shaft S2 is turned in the same direction as the lever 50, and the movable clamping plate 21 is closed against the force of the compression coil spring 24. As a result, the bottom end of the printing plate 3 is clamped by the movable clamping plate 21.

In reverse, when the second plate clamp B is going to release the bottom end of the printing plate 3, the driving arm 42 strikes the plate releasing roller 52, and the lever 50 is returned to the solid line position in FIG. 10. Next, the cam shaft S2 is turned in the direction opposite to the direction when the camshaft S2 is turned to clamp the printing plate 3, and each movable clamping plate 21 is opened by the force of the compression coil spring 24. As a result, the bottom end of the printing plate 3 is released from the movable clamping plate 21.

The plate clamp moving mechanism E is described next. As shown in FIGS. 2 and 3, a plurality of block-shaped bases 60 are fixed inside the setting groove 2 between the first plate clamp A and the second plate clamp B. A guiding groove 60*a* is formed in each base 60 in the direction of the periphery of the plate cylinder 1. As shown in FIGS. 6 and 15, a rack 62 fixed on the inside of each clamping block 20 is slidably set inside the guiding groove 60*a*.

As shown in FIG. 2, a driving shaft S3 is rotatably mounted via bearings (not shown) in the setting groove 2 between the side walls 2*b* and 2*c* and extends in the direction of the axis of the plate cylinder 1. As shown in FIGS. 3 and 6, pinions 61 are provided on the driving shaft S3 at positions corresponding to the positions of the racks 62 such that each pinion 61 engages with one of the racks 62.

Figure 14:
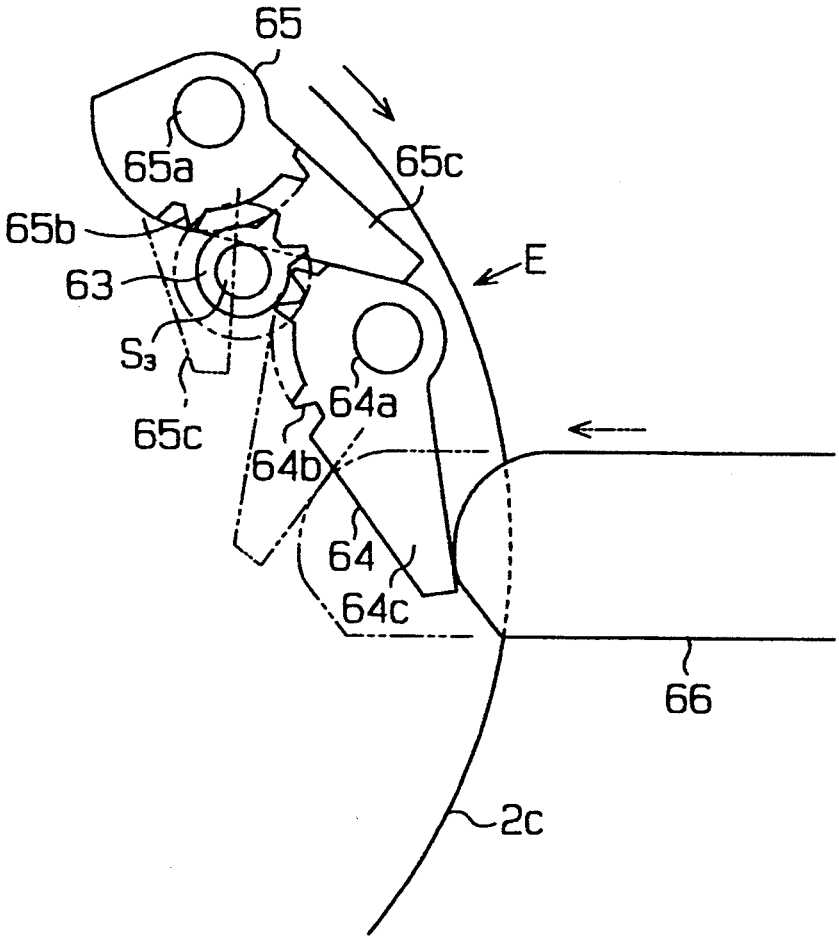
FIG. 14 is a side view showing a moving mechanism.

As shown in FIGS. 14 and 15, a spur gear 63 is fittingly fixed to an end portion of the driving shaft S3. A first lever 64 is pivotally supported by a shaft 64*a* on the side wall 2*c* in the vicinity of the spur gear 63. Similarly, a second lever 65 is pivotally supported by another shaft 65*a* on the side wall 2*c* opposite to the first lever 64. External gears 64*b* and 65*b* are provided on outer peripheries of the base portion of the first lever 64 and the second lever 65 and are engaged with the spur gear 63.

Tapered abutting portions 64*c* and 65*c* are integrally formed on the first lever 64 and second lever 65 respectively. When the second plate clamp B is going to clamp the bottom end of the printing plate 3, the plate cylinder 1 is turned, and the abutting portion 64*c* is moved to the position where the abutting portion 64*c* can meet an end of a driving arm 66. When the second plate clamp B releases the bottom end of the printing plate 3, the plate cylinder 1 is turned, and the abutting portion 65*c* is moved to the position where the portion 65*c* meets the driving arm 66 and can contact its end. The driving arm 66 flexibly reciprocates in the direction of the radius of the plate cylinder 1 by means of an air cylinder (not illustrated) activated by a switch.

When the second plate clamp B is going to clamp the bottom end of the printing plate 3, the driving arm 66 strikes the portion 64*c* in the direction of the radius of the plate cylinder 1, and the first lever 64 is pivoted clockwise to the chain line position in FIG. 14. Next, the driving shaft S3 is turned counterclockwise together with the spur gear 63. Then, the rack 62 is slid in the guiding groove 60*a* by the pinion 61, and each clamping block 20 is moved against the force of the coil spring 29 from the solid line waiting position in FIG. 12 to the solid line clamping position in FIG. 15.

When the bottom end of the printing plate 3 is clamped by the second plate clamp B and the driving arm 66 separates from the portion 64*c*, the clamping block 20 returns from the solid line position in FIG. 13 to the chain line position in FIG. 13 by the force of the coil spring 29. Then, the second plate clamp B can spread the printing plate 3 around the outer periphery of the plate cylinder 1 without any slackness. Next, as shown in FIG. 15, the driving shaft S3 is turned clockwise. As a result, the first lever 64 and the second lever 65 return to the solid line position in FIG. 14 before the printing plate 3 is clamped In reverse, when the second plate clamp B is going to release the bottom end of the printing plate 3, the driving arm 66 strikes the portion 65*c*, and the second lever 65 is pivoted clockwise to the chain line position in FIG. 14. The driving shaft S3 is turned counterclockwise together with the spur gear 63, and each clamping block 20 is moved from the chain line position in FIG. 13 to the solid line position in FIG. 13 against the force of the coil spring 29. As a result, the tension of the printing plate 3 spread around the outer periphery of the plate cylinder 1 is released to allow the printing plate 3 to be easily detached therefrom.

When the bottom end of the printing plate 3 is released from the second plate clamp B and the driving arm 66 separates from the portion 64*c*, the clamping block 20 is returned from the solid line position in FIG. 13 to the chain line position in FIG. 13 by the force of the coil spring 29. Then, the driving shaft S3 is turned clockwise, as viewed in FIG. 15. As a result, the first lever 64 and the second lever 65 return to the solid line position in FIG. 14.

A plate holding mechanism F is explained next.

Figure 19:
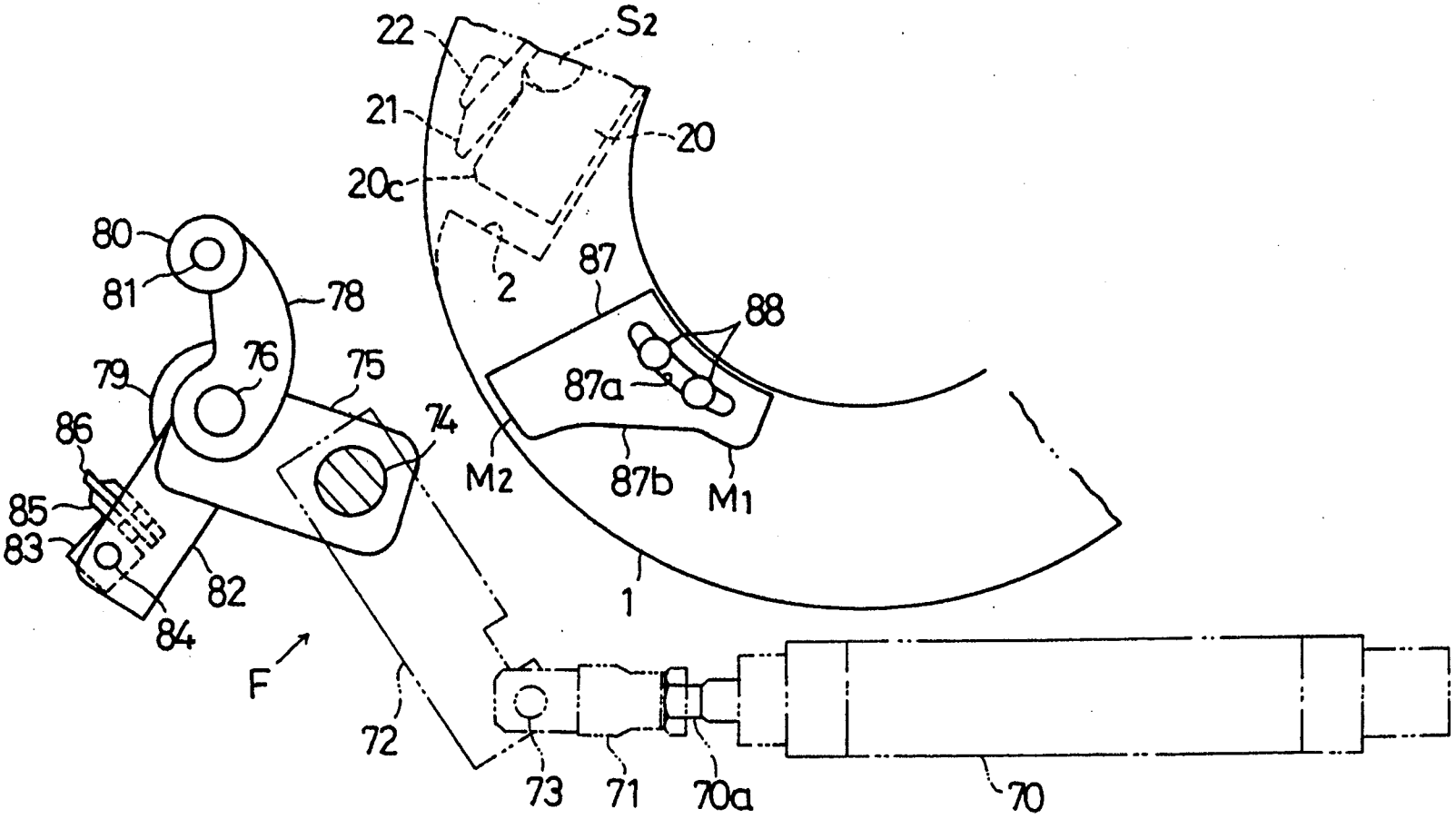
FIG. 19 is a cross sectional view taken along line 19—19 of FIG. 17, illustrating the state after a roller of the plate holding mechanism is positioned in the waiting position.

As showing FIGS. 17 and 19, a U-type connecting fitting 71 is connected to an end of a piston rod 70*a* of an air cylinder 70. An end of a connecting link 72 is rotatably connected to the connecting fitting 71 via a pin 73. The other end of the connecting link 72 is fixed on a shaft 74. The shaft 74 is rotatably supported by the side walls 4*a* and 4*b*. A pair of connecting links is fixed on the shaft 74 between the side walls 4*a* and 4*b*.

Figure 18:
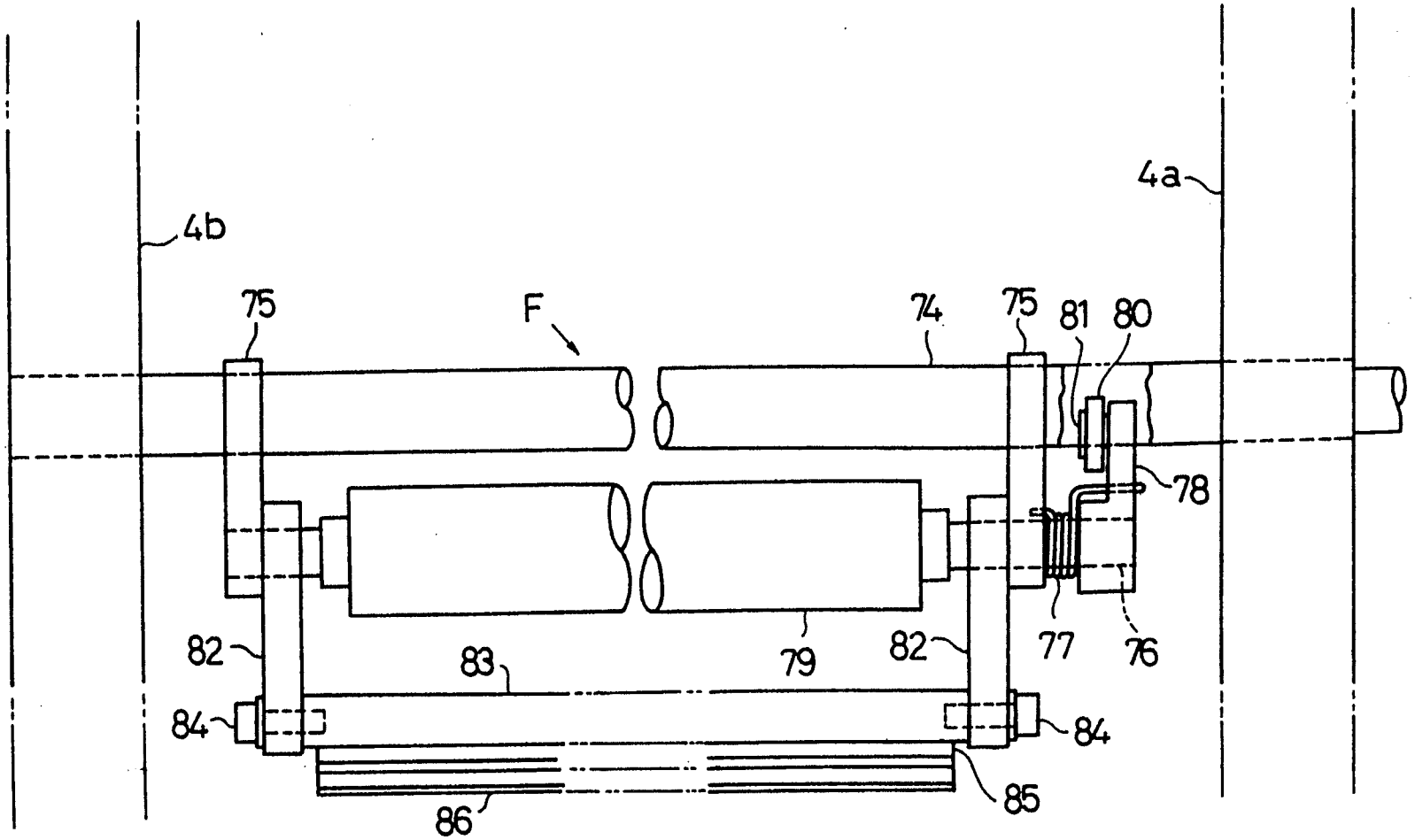
FIG. 18 is a plan view showing the plate holding mechanism.

As shown in FIGS. 18 and 19, a roller shaft 76 is rotatably supported by the other end portions of the both connecting links 75. A roller 79 is rotatably supported by the shaft 76 via bearings (not illustrated) such that the roller extends in the direction of the axis of the plate cylinder 1. In this arrangement, when the piston rod 70*a* is in a retracted state as shown in FIG. 19, the roller 79 is located in the waiting position; when the piston rod 70*a* is in an extended state as shown in FIG. 20, the roller 79 is located in the working position where the roller 79 holds the printing plate 3 against the plate cylinder 1.

As shown in FIG. 18, an end of a swinging lever 78 is fixed on the right end of the shaft 76. A torsion coil spring 77 is loosely set on the shaft 76 between the connecting link 75 and the swinging lever 78. End portions of the torsion coil spring 77 are each hooked on the connecting link and the swinging lever. A roller 80 is rotatably supported by an end portion of a shaft 81 connected to the other end of the swinging lever 78. End portions of a pair of driven levers 82 are fixed on the shaft 76 between the side walls 4*a* and 4*b*. The driven levers 82 are arranged to swing together with the shaft 76 between the waiting position shown in FIG. 20 and the working position shown in FIG. 21. A supporting rod 83 is fixed to the other end portions of both driven levers 82 by means of machine screws 84 such that the supporting rod 83 extends between the both driven levers 82 in the direction of the axis of the roller 79. A pair of clamping plates 85 is fixed on an end portion of the supporting rod 83 such that the clamping plates 85 extend in the direction of the axis of the roller 79. A rubber blade 86 is tightly fixed between the clamping plates 85 by means of machine screw or the like (not illustrated). An end portion of the blade 86 protrudes from each clamping plate 85. The protruding end of the blade 86 is formed slant.

Figure 20:
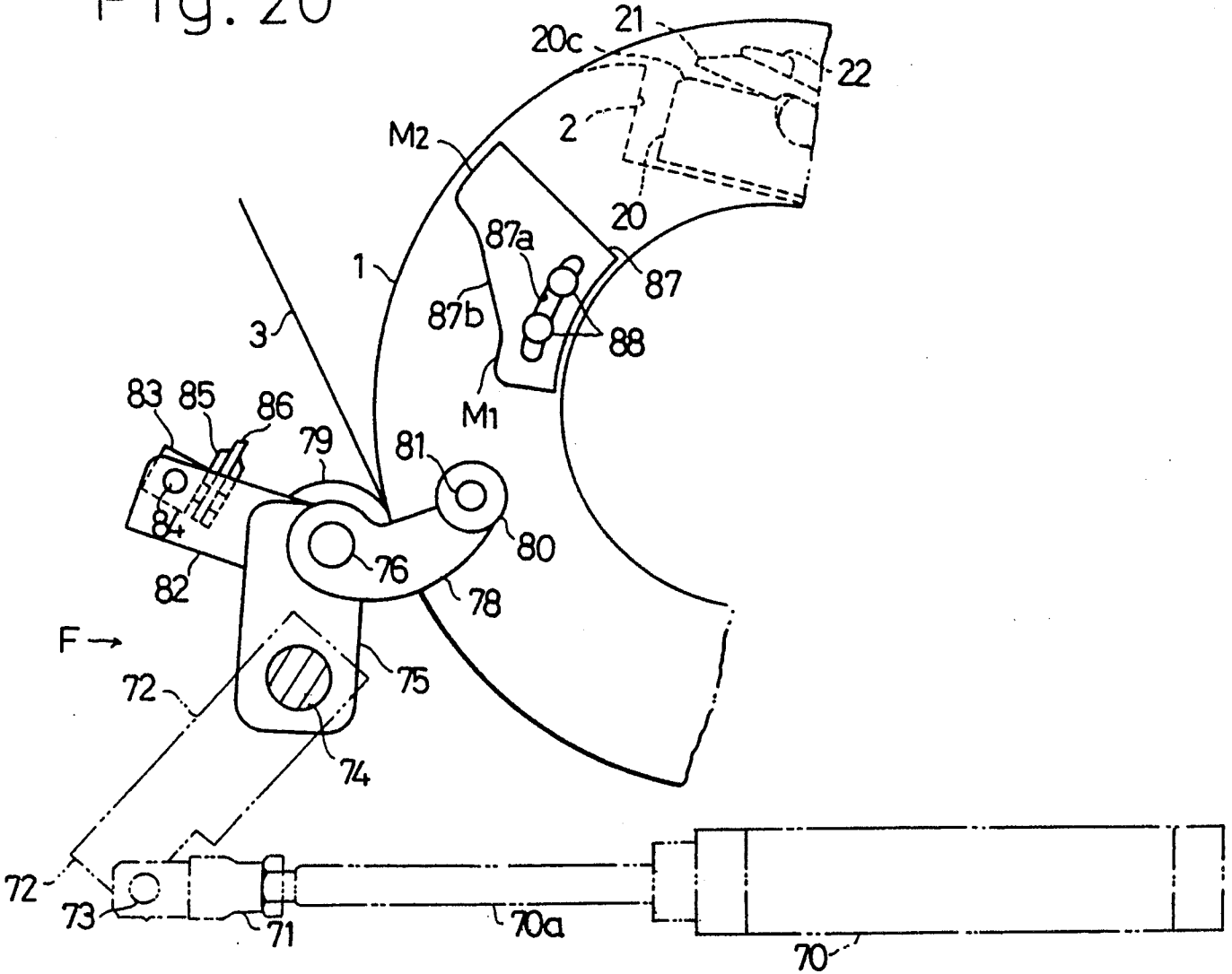
FIG. 20 is a cross sectional view taken along line 19—19 of FIG. 17, illustrating the state after a roller of the plate holding mechanism is positioned in the working position.
Figure 21:
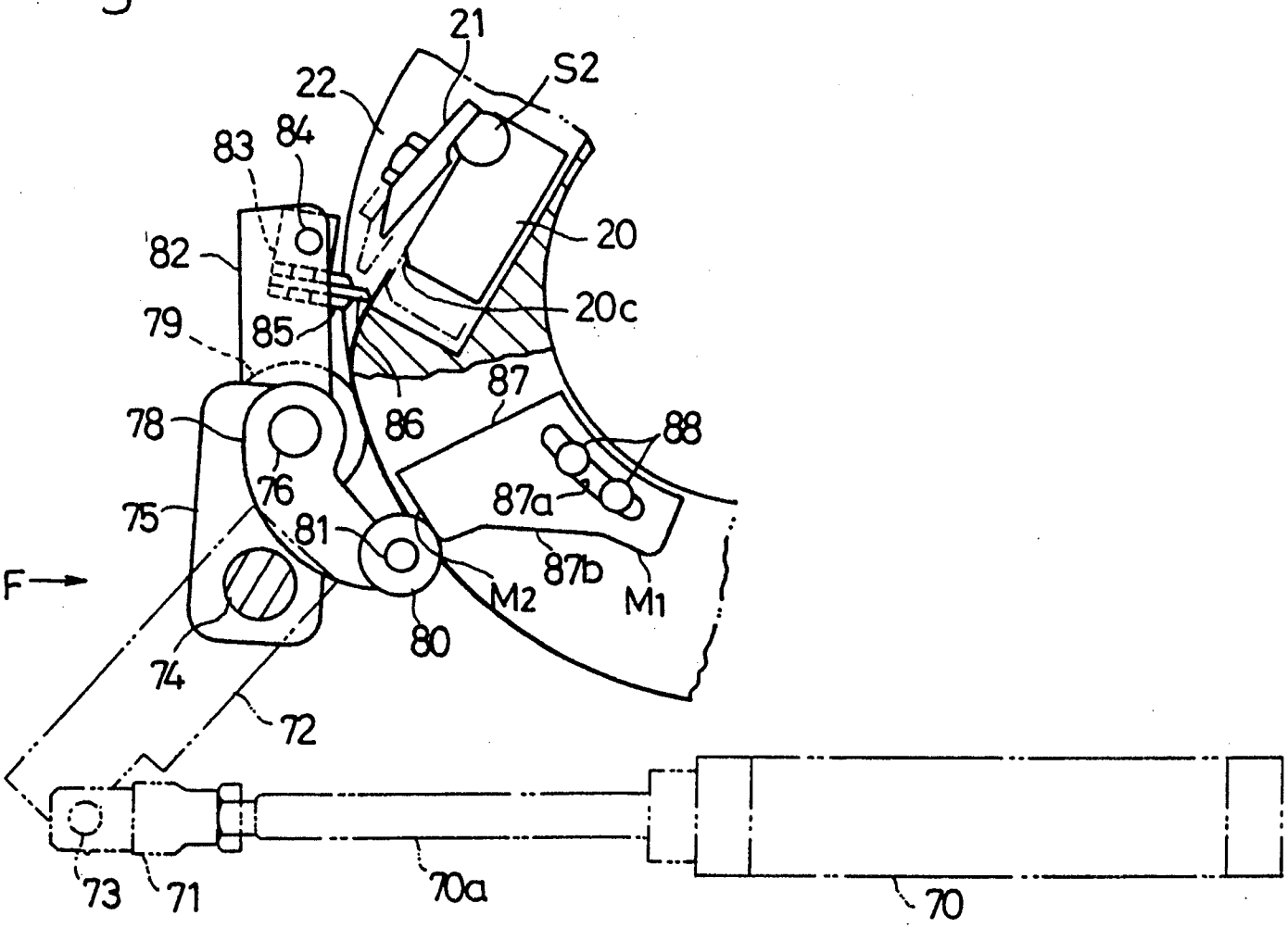
FIG. 21 is a cross sectional view taken along line 19—19 of FIG. 17, illustrating the state after a blade of the plate holding mechanism holds the bottom end of the printing plate.
Figure 22:
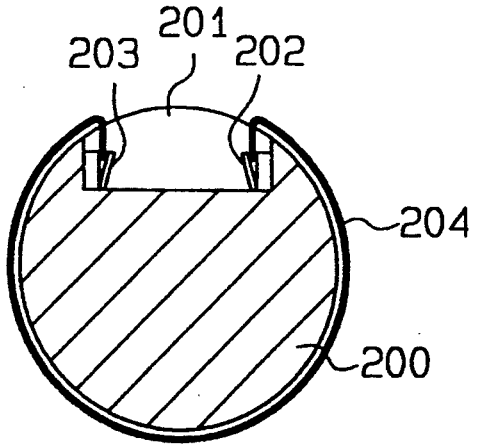
Fig.22 (Prior Art)
FIG. 22 is a diagrammatic cross sectional view showing the conventional plate cylinder.
Figure 23:
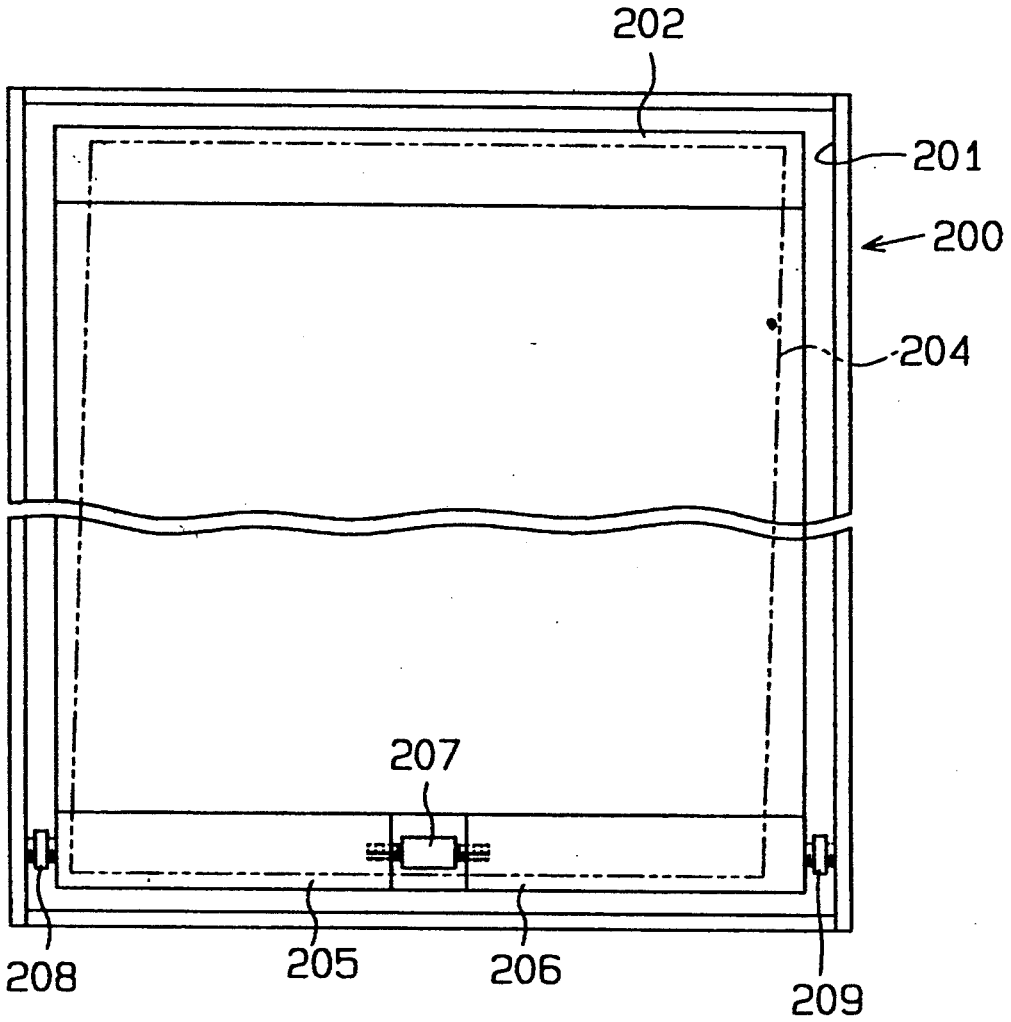
Fig.23 (Prior Art)
FIG. 23 is a development of the conventional plate cylinder.
Figure 24:
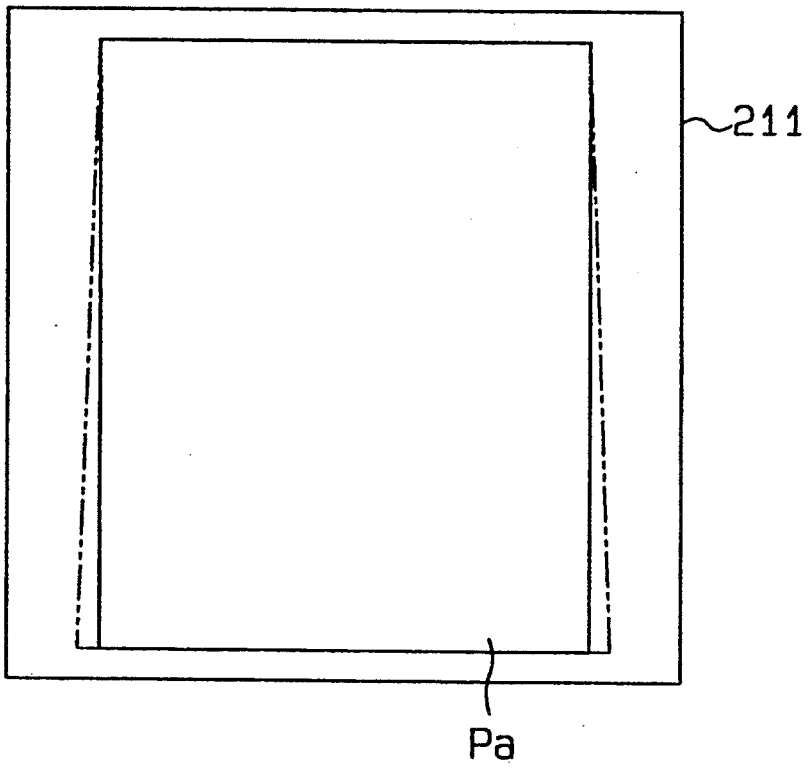
Fig.24 (Prior Art)
FIG. 24 is a descriptive schematic illustrating a printing sheet expanded by "fanout"
Figure 25:
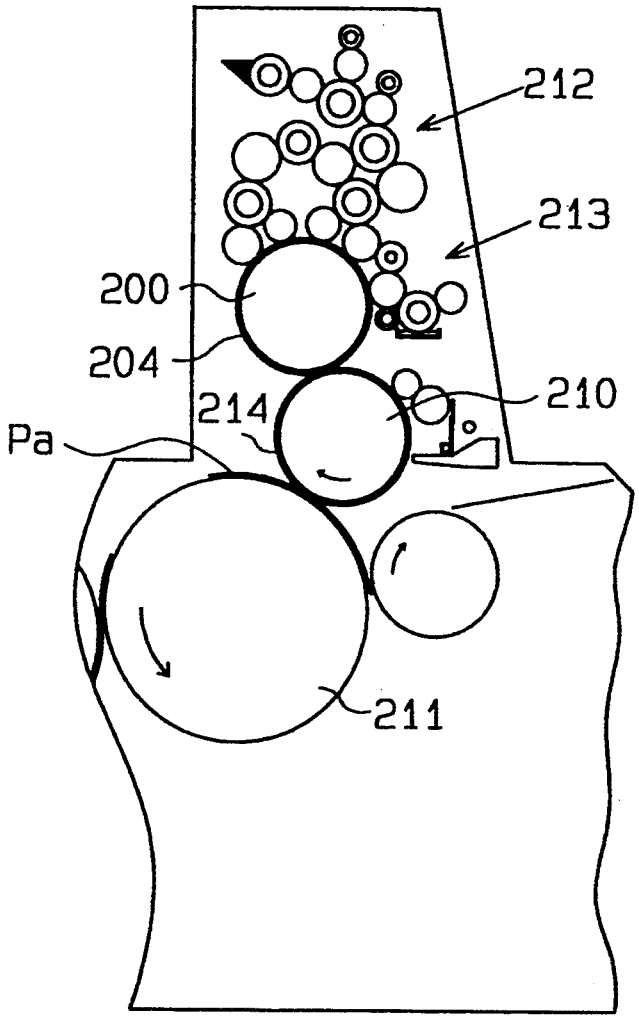
Fig.25 (Prior Art)
FIG. 25 is a schematic view showing a general type offset press.

As shown in FIGS. 17, 20 and 21, a plate holding cam 87 is fixed by means of a pair of machine screws 88 on the right side of the plate cylinder 1. A long setting hole 87*a* is formed in the plate holding cam 87 for adjusting the position of the plate holding cam 87. When the plate cylinder 1 is turned, the roller 80 is pressed against a cam face 87*b* of the plate holding cam 87 by the force of the torsion coil spring 77 and ready for moving from a waiting face M1 to a working face M2. When the roller 80 moves to the working face M2 of the plate holding cam 87, the swinging lever 78 and the driven lever 82 are moved to the working position, and the end of the blade 86 is activated to hold the bottom end of the printing plate 3 in the direction of the radius of the plate cylinder 1.

The printing unit is operated as follows.

First, before the printing plate 3 is set to the plate cylinder 1, the position of the plate holding cam 87 is adjusted. As shown in FIG. 11, while the movable clamping plate 12 of the first plate clamp A is open, the top end of the printing plate 3 is inserted between the clamping block 10 and the movable clamping plate 12. If the operation switch (not illustrated) is manipulated thereafter, the driving arm 42 is moved by an air cylinder (not illustrated) in the chain line arrow direction of the axis of the plate cylinder 1, and the plate clamping roller 41 is struck by the driving arm 42. Then, the plate clamping lever 40 is pivoted clockwise as viewed in FIG. 41, and the cam shaft S1 is turned clockwise as shown in FIG. 12. Next, the movable clamping plate 12 is closed against the force of the compression coil spring 15, and the top end of the printing plate 3 is clamped by the first plate clamp A.

When the roller 41 moves as shown in FIG. 9, the portion 43*b* is pressed, and the plate releasing lever 43 is pivoted counterclockwise as viewed in FIG. 9. After striking the roller 41, the driving arm 42 returns to the original position, and the plate cylinder 1 is turned counterclockwise as viewed in FIG. 12. Next, as shown in FIG. 10, the plate cylinder 1 comes to stop at the position where the plate clamping roller 51 meets the driving arm 42.

As shown in FIG. 20, when the air cylinder 70 is activated, the piston rod 70*a* extends. Simultaneously, the connecting link 75 is pivoted clockwise as viewed in FIG. 20, and the roller 79 is caused to contact the outer periphery of the plate cylinder 1. Then, the plate cylinder 1 is turned counterclockwise as viewed in FIGS. 12 and 20, and the printing plate 3 is wound around the plate cylinder 1 while being pressed by the roller 79 against the plate cylinder 1.

As shown in FIG. 21, while the roller 79 keeps pressing the printing plate 3 against the plate cylinder 1, the roller 80 rolls from the waiting face M1 of the plate holding cam 87 to the working face M2 thereof against the force of the coil spring 77 (FIG. 18). Then, the swinging lever 78 is pivoted from the waiting position to the working position, and the driven lever is pivoted from the waiting position to the working position. Simultaneously, the end portion of the blade 86 enters the setting groove 2 of the plate cylinder 1, and the bottom end of the printing plate 3 is held at the position by the end portion of the blade 86.

At this time, as shown in FIG. 10, the plate clamping roller 51 is at a stopped position to contact the driving arm 42. As shown in FIG. 14, when the operation switch (not illustrated) is manipulated in this state, the driving arm 66 is moved by the air cylinder (not illustrated) in the chain line arrow direction of the radius of the plate cylinder 1 in FIG. 14. Then, the portion 64*c* is beaten by the driving arm 64, and the first lever 64 and the second lever 65 are pivoted clockwise as viewed in FIG. 14. As a result, the driving shaft S3 is turned counterclockwise as viewed in FIG. 14.

Then, as shown in FIG. 15, each pinion 61 of the driving shaft S3 is turned counterclockwise as viewed in FIG. 15, and each rack 62 is moved against the force of the coil spring 29 in the chain line arrow direction in FIG. 15 together with the clamping block 20. Simultaneously, the bottom end of the printing plate 3 is precisely inserted between the clamping block 20 and the movable clamping plate 21 while sliding over the chamfer 20*c* of the clamping block 20. At this time, the driving arm 66 remains in contact with the portion 64*c*.

In this state, the driving arm 42 is moved in the direction of the radius of the plate cylinder 1 as shown with the chain line arrow in FIG. 10. Next, when the roller 51 is struck by the driving arm 42, the lever 50 is pivoted counterclockwise as viewed in FIG. 10. Simultaneously, as shown in FIG. 13, the cam shaft S2 is turned counterclockwise as viewed in FIG. 13, and the clamping plate 21 is closed against the spring force of the compression coil spring 24. As a result, the bottom end of the printing plate 3 is clamped by the second plate clamp B.

After striking the roller 51, the driving arm 42 returns to the original position. The air cylinder 70 is activated to return the piston rod 70*a* to the original retracted position. The roller 79 and the blade 86 separate from the plate cylinder 1 in the reverse sequence.

More in detail, after the printing plate 3 is set around the plate cylinder 1 with the top and bottom ends of the printing plate 3 clamped by the first and second plate clamps A and B respectively, the driving arm 66 is moved in the chain line arrow direction in FIG. 15. Next, the clamping block 20 is moved opposite to the chain line arrow direction in FIG. 15 by the force of the coil spring 29. Then, the printing plate 3 is tightly set around the plate cylinder 1. At this time, the rack 62 is moved in the same direction as that of the clamping block 20, and the pinion 61 and the driving shaft S3 are turned clockwise as viewed in FIG. 15. As a result, the first and second levers 64 and 65 are pivoted counterclockwise as viewed in FIG. 14, and return from the chain line position towards the solid line position.

When the printing plate 3 is to be detached from the plate cylinder 1, the plate cylinder 1 is turned in the opposite direction by manipulating an operation switch (not illustrated). The portion 65*c* is then moved to the position where the portion 65*c* can meet the end of the driving arm 66. The portion 65*c* is struck by the end of the driving arm 66, and the spur gear 63 and the driving shaft S3 are turned by the driving arm 66 in the direction of clamping the printing plate 3 as described above. Next, the clamping block 20 is moved in the chain line arrow direction in FIG. 15, and the tension of the printing plate 3 against the plate cylinder 1 is released. At this time, the end of the driving arm 60 remains in contact with the portion 65*c*.

If the plate cylinder 1 is turned under this condition, the roller 52 is moved to the position where the roller can meet the end of the driving arm 42. Then, an end of the driving arm 42 in FIG. 10 is struck by the roller 52, and the lever 50 is pivoted in the direction opposite to that for clamping operation (i.e., counterclockwise as viewed in FIG. 10). Next, the connecting shaft 27 and the cam shaft S2 are turned opposite to the direction for clamping operation. Then, the cam face Sb comes to contact the step 21*a*, and the movable clamping plate 21 is opened by the spring force of the compression coil spring 24. As a result, the bottom end of the printing plate 3 is released from the second plate clamp B, and the driving arm 42 returns to the original position after striking the plate releasing roller 45. Next, the driving arm 66 is returned to the original position. The clamping block 20 is also returned to the waiting position shown with the solid line in FIGS. 11 and 12. Then, the plate cylinder 1 is turned. Subsequently, the plate releasing roller 45 is moved to the position where the plate releasing roller 45 can contact an end of the driving arm 42, and the end of the driving arm 42 is struck by the plate releasing roller 45. Simultaneously, the plate clamping roller 41 is struck by the portion 43*b*, and turned opposite to the direction for clamping operation (i.e., counterclockwise as viewed in FIG. 9). The connecting shaft 18 and the cam shaft S1 are turned opposite to the direction for clamping operation. The cam face Sa comes to contact the step 12*a*, and the movable clamping plate 12 is opened by the force of the compression coil spring 15. As a result, the top end of the printing plate 3 is released from the first plate clamp A. The driving arm 42 returns to the original position after striking the plate releasing roller 45.

After the printing plate 3 is set around the plate cylinder 1, the squareness of the printing plate 3 is adjusted by moving the second plate clamp B in the direction of the axis of the plate cylinder 1, i.e., to the left or right as viewed in FIG. 9. Next will be described a process for correcting a total distortion where the top end of the printing plate 3 clamped by the first plate clamp A is displaced to the right while the bottom end of the printing plate 3 clamped by the second plate clamp B is displaced to the left as shown in FIG. 7.

As shown in FIG. 3, when the nut 39*b* is turned to advance the adjusting bolt 39 in the protruding direction as shown by an arrow, the coil spring 35 in FIG. 5 is compressed, and the both clamping blocks 20 of the second plate clamp B are moved to the right as shown by the chain line arrow in FIG. 5 against the force of the coil spring 35.

Figure 7:
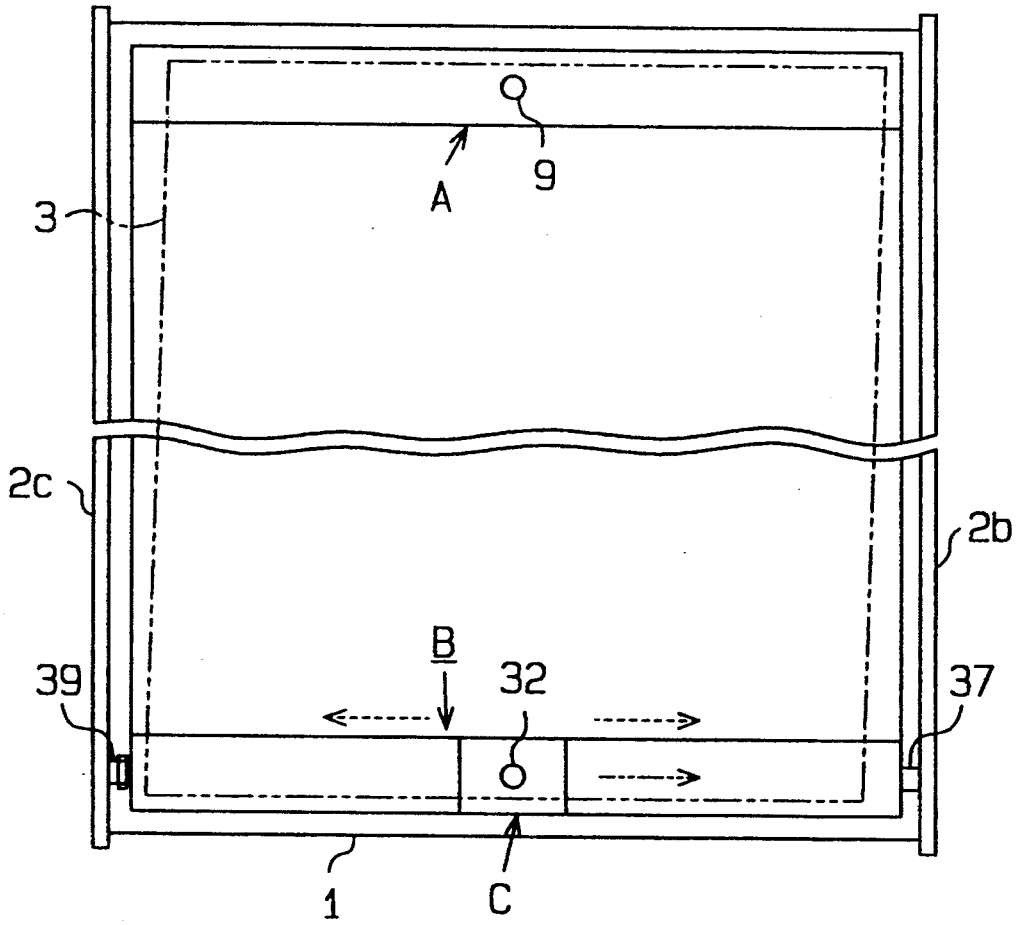
FIG. 7 is a development of the plate cylinder.

Therefore, as shown in FIG. 7, when the second plate clamp B is moved to the right as viewed by facing the plate cylinder 1, the first plate clamp A is turned around the bolt 9. Then, the bottom end of the printing plate 3 is moved in the direction of the chain line arrow as viewed by facing the plate cylinder 1 in FIG. 7, and the displacement of the top end of the printing plate 3 in relation to the bottom end thereof is removed by moving the bottom end of the printing plate 3 appropriately. If this is done, the printing plate 3 is squarely spread around the outer periphery of the plate cylinder 1.

In reverse, when the top end of the printing plate 3 clamped by the first plate clamp A is displace to the left while the bottom end of the printing plate 3 clamped by the second plate clamp B is displaced to the right as viewed in FIG. 7, the entire printing plate 3 is twisted. In this case, the adjusting bolt 39 is turned opposite to the direction described above such that the adjusting bolt 39 retreats into the second plate clamp B. Then, the bottom end of the printing plate 3 is moved to the left as viewed in FIG. 7, and the torsion of the printing plate 3 is corrected.

In the three-color offset press 100 of this embodiment, fanout is caused to the printing sheets in the second-color printing unit 102 and the third-color printing unit 103 as the bottom end thereof expands. To counter this fanout, the rotation of the plate cylinder 1 is stopped after the torsion of the printing plate 3 is adjusted by manipulating an operation switch (not illustrated). Subsequently, the adjusting worm 32 shown in FIG. 6 is turned in a proper direction, and the connecting rod 30 is turned. Simultaneously, the screw portions 30*a* and 30*b* of the connecting rod 30 are turned, and each clamping block 20 is moved outwardly to separate from each other in the direction of the axis of the plate cylinder 1 while being guided by the guide pin 33. At this time, clamping blocks 20 are supported by the side walls 2*b* and 2*c* of the setting groove 2 by the force of the coil springs 35 in FIG. 5.

Along with the separation of the clamping blocks 20 from each other, the width of the bottom end of the printing plate 3 is widened in the direction of the axis of the plate cylinder 1. Explained in detail, the width of the bottom edge of the printing plate 3 is increased as shown in FIG. 7. Thus, the entire width of the printing plate 3 is increased according to the distances traveled by the clamping blocks 20. At this time, the adjusting bolt 39 is turned to retreat the adjusting bolt 39 into the second plate clamp B by half as much as each clamping block 20 separates from the other. As a result, the torsion of the printing plate 3 is removed.

The above embodiment of the three-color offset press according to the present invention has the following desirable effects:

(1) Unlike the conventional plate clamping unit, the printing plate 3 can be easily set around the plate cylinder 1 without applying any folding process to the bottom edge of the printing plate 3. Therefore, there is no need to install any dedicated folding machine and the printing cost can be reduced. Furthermore, the bottom edge of the printing plate 3 can be automatically clamped by the second plate clamp B. Additionally, after the printing plate 3 is clamped, the second plate clamp B is moved towards the first plate clamp A by the force of the coil spring 29. Therefore, the printing plate 3 can be automatically spread around the plate cylinder 1. As a result, the time required for clamping the printing plate 3 and spreading the printing plate 3 around the plate cylinder 1 can be greatly reduced. Moreover, the end portion of the clamping block 20 of the second plate clamp B is extended from the end portion of the movable clamping plate 21. The end portion of the clamping block has a chamfer 20*c*, allowing the bottom end of the printing plate 3 to be properly inserted between the clamping block 20 and the movable clamping plate 21.

(2) When the printing plate 3 is set around the plate cylinder 1 with torsion, the second plate clamp B can be easily moved in the direction of the axis of the plate cylinder 1 by driving the adjusting bolt 39 forward or backward to remove the torsion from the printing plate 3. Therefore, unlike the conventional plate clamping unit using a plurality of adjusting bolts or the like, the plate clamping unit according to the present invention can easily remove the torsion of the printing plate 3.

(3) Each clamping block 20 can be moved in the direction of the axis of the plate cylinder 1 to be moved towards or away from each other by turning the adjustment worm 32. Therefore, the width of the second plate clamp B can be increased or decreased freely. As a result, even if fanout is caused to the printing plate 3 during the printing process, the width of the printing plate 3 can be easily adjusted to remove the fanout.

(4) When the printing plate 3 is set around the plate cylinder 1, the printing plate 3 can be exactly set around the outer periphery Of the plate cylinder 1 while being property pressed against the plate cylinder 1 by means of the roller 79. Therefore, the printing plate 3 can be properly set around the plate cylinder 1 without causing any clearance between the printing plate 3 and the plate cylinder 1. Furthermore, the printing plate 3 does not come off from the plate cylinder 1 while being set therearound.

(5) Before the bottom edge of the printing plate 3 is clamped by the second plate clamp B, the end of the blade 86 keeps holding the bottom edge of the printing plate 3 against the plate cylinder 1, allowing the bottom edge of the printing plate 3 to be firmly clamped by the second plate clamp B.

(6) The timing of holding the printing plate 3 by the blade 86 can be freely changed by adjusting the position of the plate holding cam 87 irrespective of the type of the printing plate 3. The present invention is not limited to the above described embodiment and may be embodied in many other forms as well without departing from the spirit or scope of the invention. Specific examples of modifications include the following:

(1) In the above embodiment, the plunger 37 is arranged so las to be energized by the coil spring 35. However, the plunger 37 can be substituted by the coil spring 35. Alternatively, the coil spring 35 can be substituted by any form of spring, such as a leaf spring.

(2) The plate clamping lever 40, the plate releasing lever 43, the lever 50, the first lever 64, the second lever 65, and the driving arm 42 and 66 can be substituted by a motor. Specifically, the printing plate 3 can be clamped or the second plate clamp B can be moved by connecting the spindle of the motor with the cam shafts S1 and S2 and the driving shaft S3 for driving when printing is not in process, if it is necessary to do so.

(3) A plurality of external gears and racks are provided for the plate clamp moving mechanism E to move the clamping blocks 20 in the direction of the periphery of the plate cylinder 1. The number of the external gears and racks can be increased or decreased.

(4) The shape of the plate holding cam 87 can be changed irrespective of the above embodiment.

What is claimed is:

1. A plate clamping unit for use in an offset press machine comprising:

a printing plate having a first end and a second end;

a plate cylinder for carrying the printing plate;

a first clamping mechanism movable in the radial direction of the plate cylinder for the opening and closing motions, said first mechanism being arranged to clamp the first end of the printing plate when closed;

a second clamping mechanism movable in the radial direction of the plate cylinder for the opening and closing motions, said second mechanism being arranged to clamp the second end of the printing plate when closed;

said plate cylinder having a groove extending in the axial direction on the outer periphery of the cylinder for accommodating the first and second clamping mechanism and allowing the entire second clamping mechanism to move between a waiting position in a vicinity of the first clamping mechanism and a working position away from the first clamping mechanism, said groove having an inner wall surface facing towards the outer periphery of the cylinder; and a moving mechanism for moving the second clamping mechanism between the waiting position and the working position.

2. The plate clamping unit according to claim 1 further comprising spring means disposed between the second clamping mechanism and the inner wall of the groove to forcively return the second clamping mechanism from the working position to the waiting position.

3. The plate clamping unit according to claim 1, wherein said moving mechanism includes:

a lever rotatably mounted on an end of the plate cylinder;

a driving shaft disposed in the groove, said driving shaft having external gears on its outer peripheral surface and being rotated with the lever; and a rack secured to the second clamping mechanism, said rack being engaged with the external gears.

4. The plate clamping unit according to claim 1, wherein said first clamping mechanism includes:

a first clamping block; and first clamping means movable between opening and closing positions in respect with the first clamping block, said first clamping means being arranged to clamp the first end of the printing plate in cooperation with the first clamping block.

5. The plate clamping unit according to claim 4, wherein said second clamping mechanism includes:

a second clamping block; and second clamping means movable between opening and closing positions in respect with the second clamping block, said second clamping means being arranged to clamp the second end of the printing plate in cooperation with the second clamping block.

6. The plate clamping unit according to claim 5, wherein said first clamping mechanism includes:

a first cam shaft disposed in a cam housing groove which is formed in the first clamping block and under a step formed on the first clamping means, said first cam shaft being arranged to move the first clamping means from the opening position to the closing position; and a biasing means disposed between the first clamping block and the first clamping means for biasing the first clamping means to the opening position.

7. The plate clamping unit according to claim 6, wherein said second clamping mechanism include includes:

a second cam shaft disposed in the cam housing groove, said second cam shaft being arranged to move the second clamping means from the opening position to the closing position;

an energizing means for pressing the second clamping means in the direction of opening, said energizing means being provided between the second clamping block and second movable clamping.

8. The plate clamping unit according to claim 7, wherein said second clamping block includes a chamfer for guiding the second end of the printing plate.

9. The plate clamping unit according to claim 8, further comprising:

a first clamp activating mechanism connected to the first cam shaft for activating the first clamping mechanism to perform clamping operation; and a second clamp activating mechanism connected to the second cam shaft for activating the second clamping mechanism to perform clamping operation.

10. The plate clamping unit according to claim 9, wherein said first clamp activating mechanism includes:

a plate clamping lever secured to the first cam shaft; and a plate releasing lever rotatably supported by the end portion of the plate cylinder and in contact with the plate clamping lever.

11. The plate clamping unit according to claim 10, wherein said second clamp activating mechanism includes;

a lever secured to the second cam shaft at the intermediate position and provided with a plate clamping roller, said second clamp activating mechanism having a plate releasing roller at the each end.

biasing means disposed in a second end portion of the clamping mechanism for supporting the torsion adjusting screw in the pressing manner to the inner surface of the groove.

12. The plate clamping unit according to claim 9, wherein said first clamping mechanism includes:

a first clamping block; and first movable clamping means openable with respect to the first clamping block for holding the first end of the printing plate with the first clamping block;

and the second clamping mechanism includes:

a second clamping block; and second movable clamping means openable with respect to the second clamping block for holding the second end of the printing plate with the second clamping block.

13. The plate clamping unit according to claim 9, wherein said first clamping mechanism includes:

said first clamping block having a first cam housing groove;

a first cam shaft disposed in said first cam housing groove for moving the first movable clamping means from the closing position to the open position;

a first biasing means disposed between the first clamping block and first movable clamping means for pressing the first clamping means to the open position;

and said second clamping mechanism includes:

said second clamping block having a second cam housing groove;

a second cam shaft disposed in said second cam housing groove for moving the second movable clamping means from the closing position to the open position;

a second biasing means disposed between the second clamping block and the second movable clamping means for pressing the second clamping means to the open position.

14. The plate clamping unit according to claim 12, further comprising:

said first clamping mechanism being rotatably supported in the groove;

said second clamping mechanism being movable in the axial direction of the plate cylinder in the groove, said second clamping means having a first and a second end;

a torsion adjusting screw disposed at a first end of the second clamping mechanism for moving the plate cylinder in the longitudinal direction thereof; and a biasing means disposed at a second end of the second mechanism for pressing the torsion adjusting screw toward the inner wall of the groove.

15. The plate clamping unit according to claim 13, wherein said biasing means is a coil spring.

16. The plate clamping unit according to claim 10, further comprising:

a first clamp activating mechanism connected to the first cam shaft for activating the first clamping mechanism to perform clamping operation; and a second clamp activating mechanism connected to the second cam shaft for activating the second clamping mechanism to perform clamping operation.

17. The plate clamping unit according to claim 12, wherein said first clamp activating mechanism includes:

a first lever secured to the first cam shaft; and a plate releasing lever rotatably connected to the plate cylinder and in contact with the plate clamping lever; and said second clamp activating mechanism includes;

a second lever secured to the second cam shaft at the middle position, said second lever supporting a first roller for clamping the printing plate and a second roller for releasing the printing plate, at the respective ends.

18. A plate clamping unit for use in an offset press comprising:

a printing plate having a first and a second ends;

a plate cylinder for receiving a printing plate;

a first clamping mechanism for holding the first end of the printing plate;

a second clamping mechanism for holding the second end of the printing plate;

said plate cylinder having a groove extending in the axial direction of the plate cylinder on the outer periphery for carrying the first and the second clamping mechanisms;

said first and the second clamping mechanism being arranged to rotate and move in the axial direction of the plate cylinder;

a torsion adjusting screw disposed in a first end portion of the clamping mechanism for adjusting the torsion of the printing plate in accordance with the movement of the plate cylinder in it axial direction; and 19. A plate clamping unit for use in an offset press machine comprising:

a printing plate having a first end and a second end;

a plate cylinder for carrying the printing plate;

a first clamping mechanism for clamping the first end of the printing plate;

a second clamping mechanism for clamping the second end of the printing plate;

said plate cylinder having a groove axially extending in the outer peripheral surface of the cylinder, said groove having an inner wall for mounting the first and second clamping mechanism;

said second clamping mechanism including a plurality of clamping modules juxtaposing in the axial direction of the plate cylinder;

a connecting member for connecting the clamping modules and changing distances between the adjacent clamping modules for in response to contracting of printing sheets; and biasing means disposed at ends of the clamping modules for pressing the second clamping mechanism in the groove.

20. The plate clamping unit according to claim 19, wherein said first clamping mechanism includes:

a first clamping block; and a first movable clamping means openable with respect to the first clamping block for holding the first end of the printing plate with the first clamping block; and each clamping unit includes:

a clamping block; and a movable clamping means openable with respect to the clamping block for holding the second end of the printing plate with the clamping block.

21. The plate clamping unit according to claim 20, wherein said first clamping mechanism includes:

a first cam shaft for moving the first movable clamping means to the closing position, said first cam shaft being housed within a cam housing groove formed in the first clamping block and under a step formed on the first clamping means; and a biasing means disposed between the first clamping block and first movable clamping means for pressing the first clamping means to the opening position;

and said second clamping mechanism includes:

a second cam shaft for moving the movable clamping means to the closing position, said second cam shaft being housed within a cam housing groove formed in the clamping block and under a step formed on the clamping means; and a biasing means for pressing the clamping means to the opening position, said biasing means being provided between the clamping block and movable clamping means.

22. The plate clamping unit according to claim 21 wherein:

said second clamping mechanism includes a first end and a second end, and being arranged to move in the axial direction of the plate cylinder;

said biasing means includes a torsion adjusting screw disposed at the first end of the second mechanism for forward and backward movements, for moving the plate cylinder in the longitudinal direction of the cylinder; and said plate clamping unit further comprises a coil spring disposed at the second end of the second clamping mechanism for pressing the torsion adjusting screw to the inner wall of the groove.

23. The plate clamping unit according to claim 22, further comprising:

a first clamp activating mechanism for activating the first clamping mechanism to perform clamping operation, said first clamp activating mechanism being connected to the first cam shaft; and a second clamp activating mechanism for activating the second clamping mechanism to perform clamping operation, said second clamp activating mechanism being connected to the second cam shaft.

24. The plate clamping unit according to claim 23, wherein said first clamping mechanism includes:

a plate clamping lever fixed to the first cam shaft; and a plate releasing lever rotatably supported by the end portion of the plate cylinder and being in contact with the plate clamping lever;

and said second clamp activating mechanism includes:

a lever fixed to the second cam shaft at the intermediate position and provided with a plate clamping roller and a plate releasing roller at the respective ends thereof.

25. A plate clamping unit for use in an offset press comprising:

a printing plate having a first and a second ends;

a plate cylinder for carrying the printing plate;

a first clamping mechanism for holding the first end of the printing plate, said first clamping mechanism being movable in the radial direction of the plate cylinder for an opening and a closing motions;

a second clamping mechanism for holding the second end of the printing plate, said second clamping mechanism being movable in the radial direction of the plate cylinder for an opening and a closing motions;

a setting groove extending in the axial direction in the outer periphery of the plate cylinder for accommodating the first and the second clamping mechanisms;

said second clamping mechanism movably disposed in the setting groove between the waiting position in the vicinity of the first clamping mechanism and the working position away from the first clamping mechanism;

a moving mechanism for moving the second clamping mechanism from the waiting position to the working position;

a torsion adjusting screw for adjusting the torsion of the printing plate by moving the plate cylinder in the direction of the axis thereof, said torsion adjusting screw being screwed in one end portion of the clamping mechanism; and a biasing means for pressing the torsion adjusting screw against the inner wall of the setting groove, said biasing means being provided at the other end portion of the clamping mechanism.

26. A plate clamping unit for use in an offset press comprising:

a printing plate having a first and a second ends;

a plate cylinder for carrying the printing plate;

a first clamping mechanism being movable in the radial direction of the plate cylinder for opening and closing motions for holding the first end of the printing plate;

a second clamping moveable in the radial direction of the plate cylinder for the opening and closing motions for holding the second end of the printing plate;

a groove formed in the outer periphery of the plate cylinder so as to extend in the axial direction of the plate cylinder, for accommodating the first and the second clamping mechanisms;

said second clamping mechanism being movable between the waiting position closed to the first clamping mechanism and the working position away from the first clamping mechanism;

a moving mechanism for moving the second clamping mechanism from the waiting position to the working position;

said second clamping mechanism having a plurality of clamping modules juxtaposing in the axial direction of the the plate cylinder;

connecting means for connecting the clamping modules and changing distance between the clamping modules in response to contracting of printing sheets; and a biasing means disposed at ends of clamping modules for pressing the second clamping mechanism.

27. A plate clamping unit for use in an offset press comprising:

a printing plate having a first and a second ends;

a plate cylinder for being set with the printing plate;

a first clamping mechanism for clamping the first end of the printing plate;

a second clamping mechanism for clamping the second end of the printing plate;

a groove formed in the outer periphery of the plate cylinder so as to extend in the axial direction of the plate cylinder, for accommodating the first and the second clamping mechanisms;

said second clamping mechanism being movable between the waiting position closed to the first clamping mechanism and the working position away from the first clamping mechanism;

a moving mechanism for moving the second clamping mechanism from the waiting position to the working position;

said second clamping mechanism having a plurality of clamping modules juxtaposing in the axial direction of the the plate cylinder;

a torsion adjusting screw screwed in an end portion of the clamping mechanism for adjusting the torsion of the printing plate by moving the plate cylinder in the axial direction;

said second clamping mechanism including a plurality of clamping modules placed side by side in the axial direction of the plate cylinder;

a connecting means for connecting the clamping modules to adjust each distance between the clamping modules in response to contracting of printing sheets; and a biasing means disposed at ends of clamping modules for pressing the second clamping mechanism.

28. A plate clamping unit for use in an offset press comprising:

a printing plate having a first and a second ends;

a plate cylinder for receiving the printing plate;

a first clamping mechanism being movable in the radial direction of the plate cylinder for opening and closing motions for holding the first end of the printing plate;

a second clamping moveable in the radial direction of the plate cylinder for the opening and closing motions for holding the second end of the printing plate;

a groove formed in the outer periphery of the plate cylinder so as to extend in the axial direction of the plate cylinder, for accommodating the first and the second clamping mechanisms;

said second clamping mechanism being movable between the waiting position closed to the first clamping mechanism and the working position away from the first clamping mechanism;

a moving mechanism for moving the second clamping mechanism from the waiting position to the working position;

said one of first and second mechanisms being arranged to rotate in the groove;

said one of first and second clamping mechanisms being arranged to move in the axial direction of the plate cylinder;

a torsion adjusting screw disposed at an end of the clamping mechanism for adjusting the torsion of the printing plate by moving the plate cylinder in the axial direction;

first biasing means disposed at the other end portion of the clamping mechanism movably for pressing the torsion adjusting screw against the inner wall of the groove;

said second clamping mechanism including a plurality of clamping modules placed side by side in the axial direction of the plate cylinder;

connecting means for connecting the clamping modules and changing distances between the clamping modules in response to contracting of printing sheets; and second biasing means disposed at ends of the clamping modules for pressing the second clamping mechanism to support in the setting groove.

* * * * *